US010179448B2

(12) United States Patent
Saito

(10) Patent No.: US 10,179,448 B2
(45) Date of Patent: Jan. 15, 2019

(54) INKJET PRINTING MACHINE

(71) Applicant: RISO KAGAKU CORPORATION, Tokyo (JP)

(72) Inventor: Mamoru Saito, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/466,030

(22) Filed: Mar. 22, 2017

(65) Prior Publication Data

US 2017/0282538 A1 Oct. 5, 2017

(30) Foreign Application Priority Data

Mar. 30, 2016 (JP) ..... 2016-068378

(51) Int. Cl.
*B41J 2/045* (2006.01)
*B41J 19/14* (2006.01)

(52) U.S. Cl.
CPC ..... *B41J 2/04505* (2013.01); *B41J 2/04586* (2013.01); *B41J 19/142* (2013.01)

(58) Field of Classification Search
CPC ... B41J 2/04505; B41J 2/04586; B41J 19/143
USPC ..... 347/9
See application file for complete search history.

(56) References Cited

U.S. PATENT DOCUMENTS 6,488,356 B1 * 12/2002 Klassen ..... G06K 15/105 347/41
2002/0006298 A1 1/2002 Morozumi et al.
2005/0219314 A1 * 10/2005 Donovan ..... B41J 2/2132 347/41
2009/0161130 A1 6/2009 Mabuchi et al.
2011/0205559 A1 * 8/2011 Kato ..... B41J 3/44 358/1.2
2014/0210888 A1 * 7/2014 Muller ..... B41J 2/2132 347/14

FOREIGN PATENT DOCUMENTS

JP 2006-334810 12/2006
JP 2011-084005 4/2011

OTHER PUBLICATIONS

Extended European Search Report for EP 17163026.2 dated Oct. 9, 2017.

* cited by examiner

*Primary Examiner* — Huan Tran
*Assistant Examiner* — Alexander D Shenderov
(74) *Attorney, Agent, or Firm* — Greenblum & Bernstein, P.L.C.

(57) ABSTRACT

An inkjet printing machine includes a controller and performs margin-less printing on a base material on the basis of image data having a size larger than that of the base material by discharging ink from an inkjet head while relatively moving the base material and the inkjet head for one cycle of reciprocation or more in a main-scanning direction. On the basis of the image data, the controller controls the inkjet head to stop discharging ink, when the inkjet head is moved from the outside toward an end of the base material. The controller controls, when the inkjet head is moved from the inside toward the end of the base material, the inkjet head to discharge ink to complement an image in a section where the inkjet head stops discharging ink.

1 Claim, 13 Drawing Sheets

GOING-WAY SIDE IMAGE DATA

RETURNING-WAY SIDE IMAGE DATA

INKJET PRINTING MACHINE

CROSS REFERENCE TO RELATED APPLICATION

This application claims benefit of priority under 35 U.S.C. § 119 to Japanese Patent Application No. 2016-068378, filed on Mar. 30, 2016, the entire contents of which are incorporated by reference herein.

BACKGROUND OF THE INVENTION

1. Field of the Invention

The present invention relates to an inkjet printing machine that reduces stains on a thickness part (sides) of a base material in margin-less printing.

2. Description of the Related Art

An inkjet printing machine performs printing on a printing medium by discharging ink from an inkjet head.

Patent Literature 1 (Japanese Patent Application Laid-Open No. 2006-334810) discloses an inkjet recording machine that includes a recording head to perform recording by discharging ink, and moving means to move the recording head relatively to a recording sheet, and performs margin-less printing by discharging ink from the recording head while moving the recording head relatively to the recording sheet.

When the recording head moves from a central part to one end of the recording sheet, the inkjet recording machine gradually reduces recording data, which is to be recorded by the recording head. Then, when the recording head moves in a direction opposite to the moving direction, which is from the central part to the one end of the recording sheet, to perform recording, the inkjet recording machine controls the recording head to complement the reduced recording data.

A shuttle-type inkjet recording machine that is provided with such an inkjet head, often uses a base material having a thickness that can be visually confirmed, such as a building material or a decorative panel, as a recording medium.

For example, when performing margin-less printing on the base material, the shuttle-type inkjet recording machine arranges an image having a size larger than that of the base material not to have a margin on edges of the base material, and discharges ink while moving the recording head from the outside of one end to the central part of the base material.

In the margin-less printing, the shuttle-type inkjet recording machine gradually reduces recording data, which is to be recorded by the recording head, when the recording head moves from the central part to another end of the base material. However, when the recording head moves from the outside of the another end to the central part of the base material, the shuttle-type inkjet recording machine discharges ink without reducing the recording data. As the inertial force acts on the ink, printing is performed not only on the surface but also on the thickness part (side) of the base material. This sometimes makes the finish of printing worse and invites user's dissatisfaction.

SUMMARY OF THE INVENTION

The present invention is made in view of the above discussion. One object of the present invention is to provide an inkjet printing machine that reduces stains on the thickness part (side) of a base material in margin-less printing.

According to a first aspect of the present invention, there is provided an inkjet printing machine that performs margin-less printing on a base material by discharging ink from an inkjet head, based on image data having a size larger than that of the base material, while relatively moving the base material and the inkjet head by a moving device for one cycle of reciprocation or more in a main-scanning direction, the inkjet printing machine comprising: a controller that controls, based on the image data, the inkjet head to stop discharging of ink when the inkjet head is moved by the moving device from an outside of the base material toward an end of the base material, and to discharge ink, when the inkjet head is moved by the moving device from an inside of the base material toward the end of the base material, to complement an image in a section in which the inkjet head stops discharging of ink.

According to a second aspect of the present invention, there is provided an inkjet printing machine that has a moving device to move an inkjet head in a main-scanning direction, and performs margin-less printing on a base material by discharging ink from the inkjet head, based on image data having a size larger than that of the base material, while relatively moving the base material and the inkjet head in the main scanning direction, the inkjet printing machine comprising: a controller that controls, when margin-less printing is performed based on first image data and second image data which are divided from the image data, the inkjet head to discharge ink based on the first image data in a direction in which the inkjet head is moved by the moving device from an outside of the base material toward one end of the base material, and based on the second image data in a direction in which the inkjet head is moved by the moving device from an outside of the base material toward another end of the base material, wherein for the first image data, discharging is stopped from the one end to a predetermined position and performed from the predetermined position to the another end on the base material, and for the second image data, discharging is stopped from the another end to the predetermined position and performed from the predetermined position to the one end on the base material.

According to a third aspect of the present invention, there is provided an inkjet printing machine that has a moving device to move an inkjet head in a main-scanning direction and in a sub-scanning direction, and performs margin-less printing on a base material by alternately repeating: an operation of discharging ink from the inkjet head based on a discharge rate that represents a ratio of the number of pixels for actually discharging ink to the number of pixels for an object to be discharged in image data having a size larger than that of the base material while relatively moving the base material and the inkjet head in the main-scanning direction; and an operation of moving the inkjet head in the sub-scanning direction after discharging ink in the main-scanning direction is finished, the inkjet printing machine comprising: an image data generator that generates image data corresponding to each of divided pitches, based on image data corresponding to each pitch for moving the inkjet head in the sub-scanning direction where the pitch is divided into a plurality of divided pitches, in a manner such that: the image data corresponding to each of the divided pitches includes, along a moving direction in the main-scanning direction, a discharge prohibition section for not discharging ink, a discharge section for discharging ink, and a gradation discharge section between the discharge prohibition section and the discharge section for discharging ink by raising a discharge rate in gradation to a discharge rate in the discharge section; and the discharge section of each of the divided pitches is superposed for the number of the divided pitches in each pitch to have a discharge rate in each pitch; and a controller that, when margin-less printing is performed based on the image data corresponding to each of the divided pitches, stops discharging ink in the discharge prohibition section and discharges ink in an order of the gradation discharge section and the discharge section when the inkjet head is moved by the moving device along the main-scanning direction from an outside of the base material toward an end of the base material, and thereafter moves the inkjet head for one divided pitch.

According to the first aspect of the present invention, when the inkjet head is moved by the moving device from an outside of the base material toward an end of the base material, the inkjet head stops discharging of ink on the basis of the image data.

The base material thus has the side surface not printed, which is on the upstream side in each of the going way and the returning way of the inkjet head. This prevents the side surface of the base material on the upstream side in each of the going way and the returning way from being stained.

In addition, according to the first aspect of the present invention, when the inkjet head is moved by the moving device from an inside of the base material toward the end of the base material, the inkjet head discharges ink to complement an image in a section in which the inkjet head stops discharging of ink when the inkjet head is moved by the moving device from the outside of the base material toward the end.

When the inkjet head is moved by the moving device from the inside of the base material toward the end of the base material, the inkjet head discharges ink on a section in which the inkjet head stops discharging of ink when the inkjet head is moved by the moving device from the outside of the base material toward the end of the base material. This enables the margin-less printing to be performed appropriately.

According to the second aspect of the present invention, when margin-less printing is performed on the basis of first image data and second image data, which are divided from the image data, the inkjet head discharges ink on the basis of the first image data in a direction in which the inkjet head is moved by the moving device from an outside of the base material toward one end of the base material, and on the basis of the second image data in a direction in which the inkjet head is moved by the moving device from an outside of the base material toward another end of the base material, wherein for the first image data, discharging is stopped from the one end to a predetermined position and performed from the predetermined position to the another end on the base material, and for the second image data, discharging is stopped from the another end to the predetermined position and performed from the predetermined position to the one end on the base material.

The inkjet head discharges ink on the basis of the first image data and the second image data that respectively correspond to sections including both ends of the base material. When the inkjet head moves from the outside of the base material toward an end of the base material, the inkjet head thus stops discharging of ink. Consequently, the base material has side surfaces on the upstream side not printed. This prevents the side surfaces of the base material on the upstream side from being stained.

According to the third aspect of the present invention, image data corresponding to each of divided pitches is generated, on the basis of image data of each pitch for moving of the inkjet head in the sub-scanning direction where the pitch is divided into a plurality of divided pitches, in a manner such that: image data corresponding to each of the divided pitches includes, along a moving direction in the main-scanning direction, a discharge prohibition section for not discharging ink, a discharge section for discharging ink, and a gradation discharge section between the discharge prohibition section and the discharge section for discharging ink by raising a discharge rate in gradation to a discharge rate in the discharge section; and the discharge section of each divided pitch is superposed for the number of the divided pitches in each pitch to have a discharge rate in each pitch. When margin-less printing is performed on the basis of the image data, discharging of ink is stopped in the discharge prohibition section, and discharging of ink is performed in an order of the gradation discharge section and the discharge section when the inkjet head is moved by the moving device along the main-scanning direction from an outside of the base material toward one end of the base material, and then the inkjet head is moved for one divided pitch.

As a result, around respective boundaries among the discharge prohibition section, the gradation discharge section, and the discharge section, the difference in discharge rates of neighboring sections does not increase. This enables the image to be reproduced with inconspicuous boundaries between sections.

Moreover, printing is performed on the basis of image data where the discharge section of each divided pitch is superposed for the number of divided pitches in each pitch to have a discharge rate in each pitch, and the inkjet head is moved for the divided pitch. Consequently, the plurality of nozzles of the inkjet head discharge ink drops in the discharge section. This prevents a decline in printing quality and makes the white steak inconspicuous even when a nozzle has the clogging.

DESCRIPTION OF THE EMBODIMENTS

Figure 1:
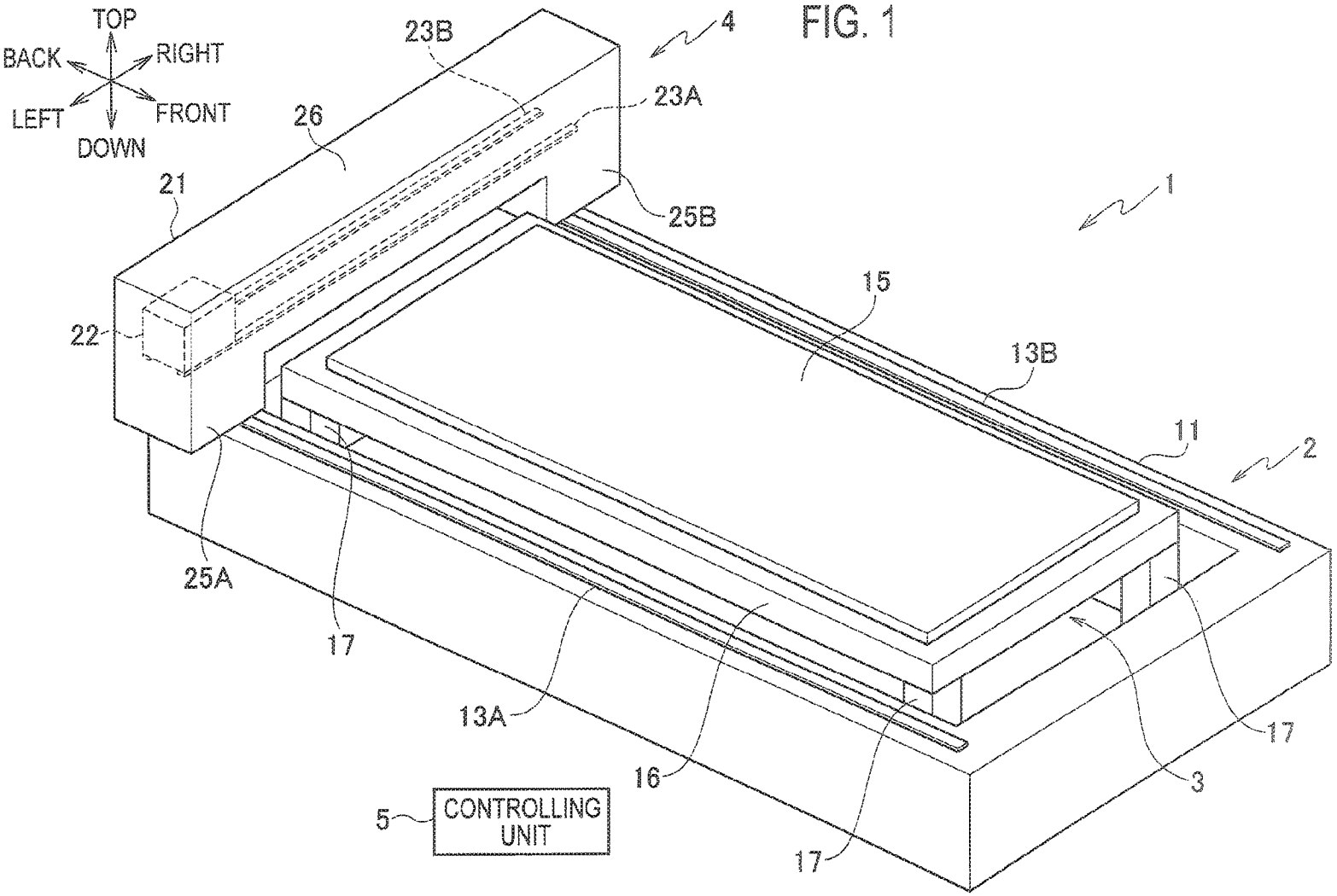
FIG. 1 is a schematic perspective view of a configuration of an inkjet printing machine according to a first embodiment of the present invention.

Exemplary embodiments of the present invention will be described below with reference to the accompanying drawings. In the drawings, the same or similar reference symbol is attached to the same or similar structural element.

The following embodiments present examples of an apparatus and the like for realizing the technical concept of the present invention. The technical concept of the present invention regarding the material, the shape, the structure, the arrangement, and the like of various structural components is not limited to the followings. Various modifications can be made in the technical concept of the present invention within the scope of claims.

First Embodiment

Figure 2:
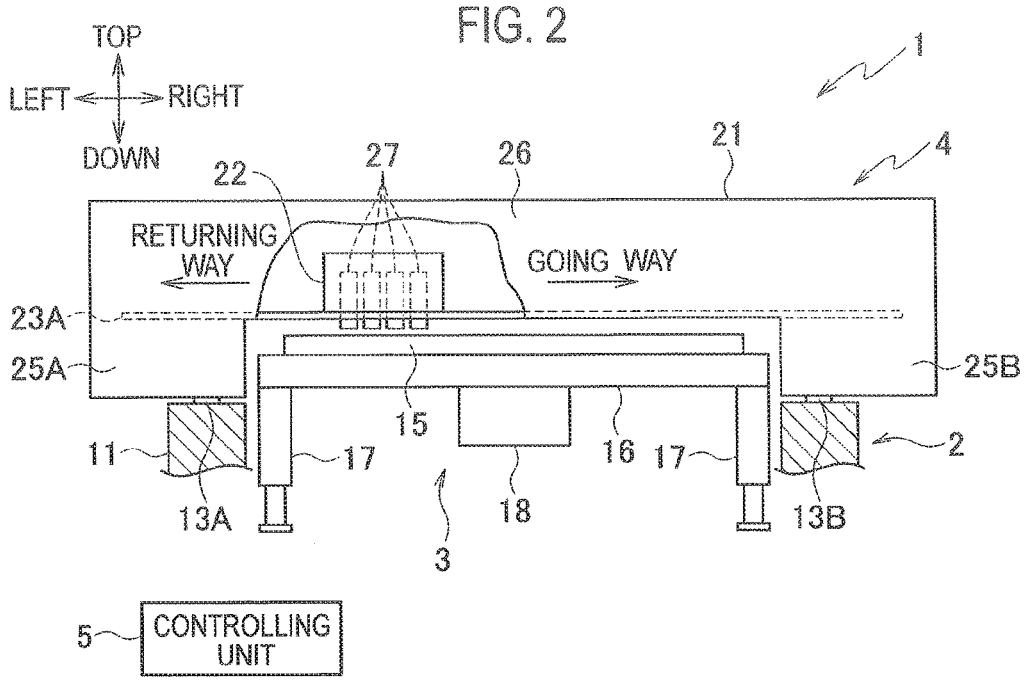
FIG. 2 is a front view of major parts of the inkjet printing machine shown in FIG. 1.
Figure 3:
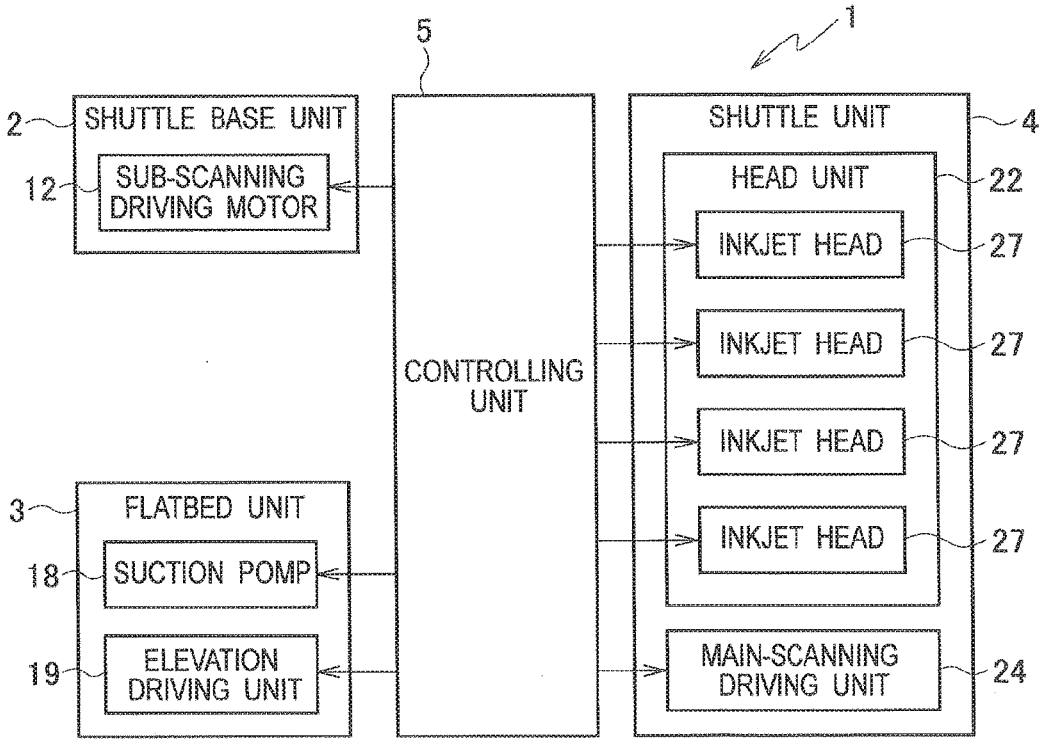
FIG. 3 is a control block diagram of the inkjet printing machine shown in FIG. 1.

FIG. 1 is a schematic perspective view of a configuration of an inkjet printing machine according to a first embodiment of the present invention. FIG. 2 is a front view of major parts of the inkjet printing machine shown in FIG. 1. FIG. 3 is a control block diagram of the inkjet printing machine shown in FIG. 1. In the following description, top and down, right and left, front and back shown with arrows in FIG. 1 define a vertical direction, a right-left direction, and a front-back direction, respectively.

As shown in FIGS. 1 to 3, an inkjet printing machine 1 includes a shuttle base unit 2, a flatbed unit 3, a shuttle unit 4, and a controlling unit 5.

The shuttle base unit 2 supports the shuttle unit 4 and moves the shuttle unit 4 in the front-back direction. The shuttle base unit 2 includes a stand 11 and a sub-scanning driving motor 12.

The stand 11 supports the shuttle unit 4. The stand 11 has a shape of a rectangular frame. Sub-scanning drive guides 13A and 13B that extend in the front-back direction are arranged on a left frame and a right frame of the stand 11, respectively. The sub-scanning drive guides 13A and 13B guide the shuttle unit 4 that moves in the front-back direction (sub-scanning direction).

The sub-scanning driving motor 12 moves the shuttle unit 4 in the front-back direction.

The flatbed unit 3 supports a base material 15, which is a printing medium constituted by a sheet, a building material or the like. The flatbed unit 3 is arranged inside (space surrounded by frames) the stand 11 of the shuttle base unit 2. The flatbed unit 3 has a mounting table 16, a plurality of leg portions 17, a suction pomp 18, and an elevation driving unit 19.

The mounting table 16 is a table on which the base material 15 is mounted. The mounting table 16 is formed in a hollow rectangular parallelepiped shape and the top surface of the mounting table 16 is a horizontal plane. The top surface of the mounting table 16 has a plurality of suction holes (not shown) formed thereon.

Air suction through the suction holes by driving the suction pomp 18, suctions and holds the base material 15 mounted on the top surface of the mounting table 16.

The mounting table 16 is supported by the leg portions 17, which are configured to be stretchable. The elevation driving unit 19 is constituted by a hydraulic elevation mechanism and the like. Driving of the elevation driving unit 19 stretches the leg portions 17 to elevate the mounting table 16.

The shuttle unit 4 prints an image on the base material 15. The shuttle unit 4 includes a housing 21, a head unit 22, main-scanning drive guides 23A and 23B, and a main-scanning driving motor 24.

The housing 21 houses the head unit 22 and the main-scanning drive guides 23A and 23B. The housing 21 is formed in the form of a gate that arches over the flatbed unit 3 in the right-left direction. The housing 21 has a left leg member 25A and a right leg member 25B that are supported by the stand 11 of the shuttle base unit 2, and the housing 21 is movable along the sub-scanning drive guides 13A and 13B. The housing 21 includes a horizontal member 26 between the leg members 25A and 25B. A bottom side of the horizontal member 26 has an opening for discharging ink from the head unit 22 to the base material 15.

The head unit 22 includes four inkjet heads 27. The four inkjet heads 27 are arranged side-by-side in the right-left direction. Each of the inkjet heads 27 includes a plurality of nozzles (not shown) arranged along the front-back direction. Theses nozzles open on a nozzle surface, which is a lower surface of the inkjet head 27. Ink drops are discharged on the base material 15 from the nozzles. Each of the four inkjet heads 41 discharges ink of a different color (for example, cyan, black, magenta, and yellow). The head unit 22 is arranged inside the housing 21 and is movable in the right-left direction.

The main-scanning drive guides 23A and 23B guide the head unit 22, which moves along the right-left direction (main-scanning direction). The main-scanning drive guides 23A and 23B are horizontally laid between the leg members 25A and 25B in the housing 21. In the right-left direction (main-scanning direction), a route where the head unit 22 moves in the right direction on the main-scanning drive guides 23A and 23B is called a going way, and a route where the head unit 22 moves in the left direction on the main-scanning drive guides 23A and 23B is called a returning way.

The main-scanning driving motor 24 moves the head unit 22 in the right-left direction.

The controlling unit 5 controls operations of respective parts of the inkjet printing machine 1. The controlling unit 5 includes a CPU, an RAM, a ROM, a hard disk, and the like. The controlling unit 5 functions as image dividing means and controlling means.

Workings of the inkjet printing machine 1 according to the first embodiment will be described below.

Figure 4:
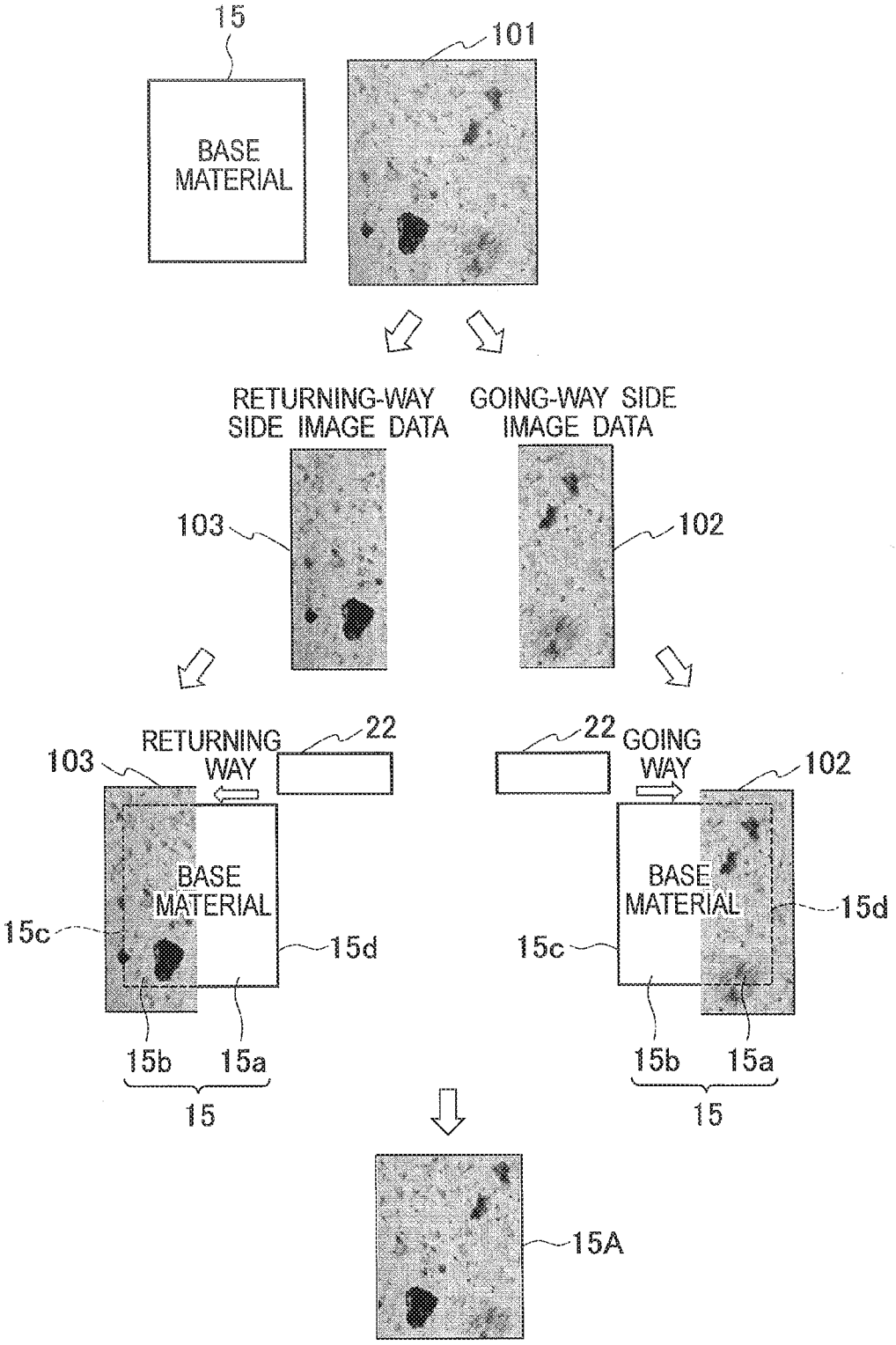
FIG. 4 is a schematic diagram illustrating workings of the inkjet printing machine according to the first embodiment of the present invention.

FIG. 4 is a schematic diagram illustrating workings of the inkjet printing machine 1 according to the first embodiment of the present invention.

As shown in FIG. 4, margin-less printing uses image data 101 having a size larger than that of the base material 15.

Before performing a print operation, the controlling unit 5 functions as image dividing means for dividing the image data 101 into two in the right-left direction (main-scanning direction) to generate going-way side image data 102 and returning-way side image data 103.

In the going way, while moving the head unit 22 in the right direction along the main-scanning drive guides 23A and 23B, the controlling unit 5 controls the inkjet heads 27 to discharge ink not using the returning-way side image data 103 but only using the going-way side image data 102, which is on the downstream side in the main-scanning direction. In the going way, as the head unit 22 moves from the left to the right, the left side is the upstream side and the right side is the downstream side. In the returning way, as the head unit 22 moves from the right to the left, the right side is the upstream side and the left side is the downstream side.

For this reason, in the going way of the head unit 22, a right half 15*a* of the base material 15 on the downstream side is printed, but a left half 15*b* of the base material 15 on the upstream side is not printed. Consequently, a side surface 15*c* of the base material 15 is not printed, which is on the upstream side in the going way of the inkjet heads 27. This prevents the side surface 15*c* of the base material 15 on the upstream side from being stained. In addition, ink drops discharged from the inkjet heads 27 do not fall on a side surface 15*d* of the right half 15*a* of the base material 15 on the downstream side, as the inertial force acts on the downstream side in the moving direction of the inkjet heads 27.

In this manner, only the right half 15*a* of the base material 15 is printed, and the left half 15*b* of the base material 15 is not printed in the going way. It is thus necessary to perform printing to complement the left half 15*b* of the base material 15.

Then, when the head unit 22 reaches the right end of the main-scanning drive guides 23A and 23B, without moving the head unit 22 in the sub-scanning direction, printing is performed in the returning way to complement the left half 15*b* of the base material 15.

In the returning way, while moving the head unit 22 in the left direction along the main-scanning drive guides 23A and 23B, the controlling unit 5 controls the inkjet heads 27 to discharge ink not using the going-way side image data 102 but only using the returning-way side image data 103, which is on the downstream side in the main-scanning direction. For this reason, in the returning way of the inkjet heads 27, the left half 15*b* of the base material 15 on the downstream side is printed, but the right half 15*a* of the base material 15 on the upstream side is not printed. Consequently, the side surface 15*d* of the base material 15 is not printed, which is on the upstream side in the returning way of the inkjet heads 27. This prevents the side surface 15*d* of the base material 15 on the upstream side from being stained. Also in this case, ink drops discharged from the inkjet heads 27 do not fall on the side surface 15*c* of the left half 15*b* of the base material 15 on the downstream side, as the inertial force acts on the downstream side in the moving direction of the inkjet heads 27.

In this manner, the head unit 22 prints the right half 15*a* of the base material 15 in the going way and the left half 15*b* of the base material 15 in the returning way along the main-scanning drive guides 23A and 23B. This one cycle of reciprocation enables printing to be performed for one head in the sub-scanning direction without staining the side surfaces 15*c* and 15*d* of the base material 15. Subsequently, the inkjet heads 27 are moved in the sub-scanning direction for one head, and then the inkjet heads 27 performs printing for one head during another one cycle of reciprocation in the main-scanning direction. By repeating these operations, the base material 15 on which the image data 101 is printed can be obtained.

Second Embodiment

The first embodiment of the present invention describes the inkjet printing machine 1, as an example, which divides the image data into two in the main-scanning direction and performs printing on the basis of one image data on the downstream side of the divided two image data. The first embodiment of the present invention has a case in which a joint, where the image data are divided, comes to notice in the printed image.

The second embodiment of the present invention will describe the inkjet printing machine 1, as an example, which divides image data in the main-scanning direction into three sections and performs printing on the basis of image data divided into three sections where the center of the three sections is set as a gradation image. The hardware configuration of the inkjet printing machine 1 according to the second embodiment of the present invention is the same as that of the inkjet printing machine 1 according to the first embodiment of the present invention shown in FIGS. 1 to 3, and thus the description is omitted.

Figure 5A:
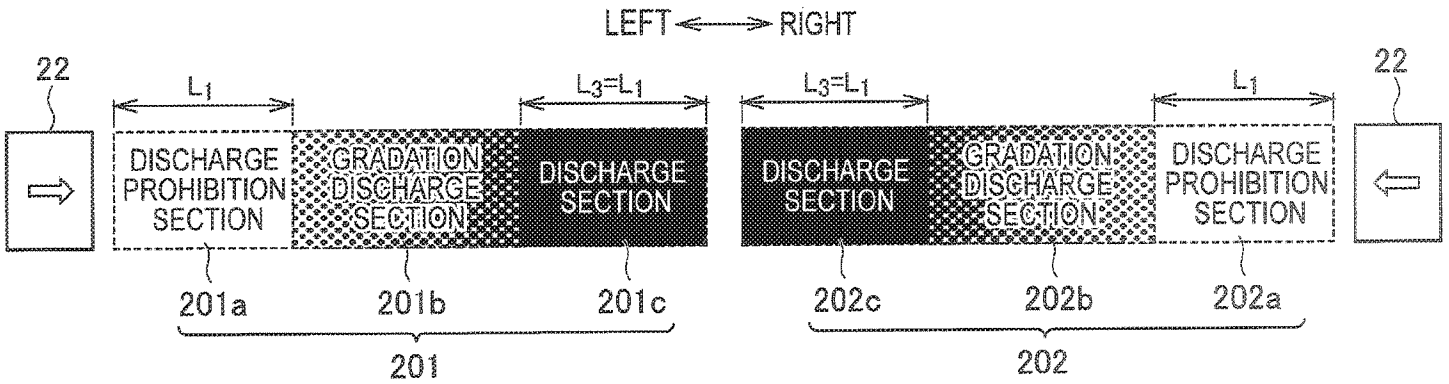
FIG. 5A is a diagram illustrating image data divided into three sections according to a second embodiment of the present invention.
Figure 5B:
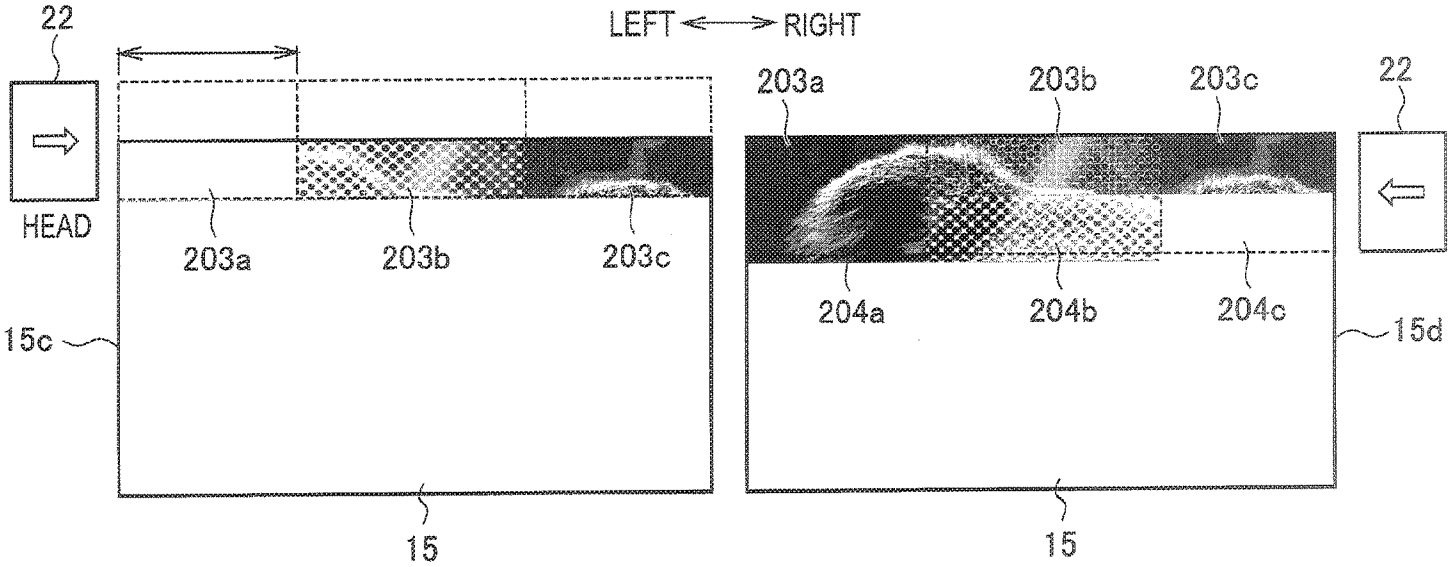
FIG. 5B is a diagram illustrating printing using the image data divided into three sections shown in FIG. 5A.

FIGS. 5A and 5B are schematic diagrams illustrating workings of the inkjet printing machine 1 according to the second embodiment of the present invention. FIG. 5A is a diagram illustrating image data divided into three sections. FIG. 5B is a diagram illustrating printing using the image data divided into three sections.

As shown in FIG. 5A, going-way side image data 201 for the going way of the head unit 22 in the right-left direction (main-scanning direction), and returning-way side image data 202 for the returning way of the head unit 22 in the right-left direction (main-scanning direction) are generated from the image data. Each of the going-way side image data 201 and the returning-way side image data 202 is divided into three sections of a discharge prohibition section, a gradation discharge section, and a discharge section from the upstream side.

The discharge prohibition section is a section where the inkjet heads 27 do not discharge ink. The discharge section is a section where the inkjet heads 27 discharge ink. The gradation discharge section is a section where the inkjet heads 27 discharge ink by raising a discharge rate in gradation from a discharge rate (zero discharge) in the discharge prohibition section to a discharge rate in the discharge section.

The going-way side image data 201 is divided into three sections of a discharge prohibition section 201*a*, a gradation discharge section 201*b*, and a discharge section 201*c* in order from the upstream side in the going way where the head unit 22 is moved in the left-to-right direction. The discharge prohibition section 201*a* here has a length of L1 in the right-left direction (main-scanning direction), which is the same as a length of L3 of the discharge section 201*c* in the right-left direction (main-scanning direction).

The returning-way side image data 202 is divided into three sections of a discharge prohibition section 202*a*, a gradation discharge section 202*b*, and a discharge section 202*c* in order from the upstream side in the returning way where the head unit 22 is moved from the right-to-left direction. The discharge prohibition section 202*a* here has a length L1 in the right-left direction (main-scanning direction), which is the same as a length L3 of the discharge section 202*c* in the right-left direction (main-scanning direction). In addition, the length L1 of the discharge prohibition section 202*a* in the right-left direction (main-scanning direction) is the same as the length L3 of the discharge section 201*c*, which complements the discharge prohibition section 202*a*, in the right-left direction (main-scanning direction).

The discharge prohibition sections 201*a*, 202*a*, and the discharge sections 201*c*, 202*c* here are all set as the same length L1. However, only the discharge prohibition section 201*a*, 202*a* should have the same length as the discharge section 202*c*, 201*c*, which respectively complement the discharge prohibition sections 201*a*, 202*a*, and the discharge prohibition section 201*a* and the discharge prohibition section 202*a* may have a different length.

Figure 6A:
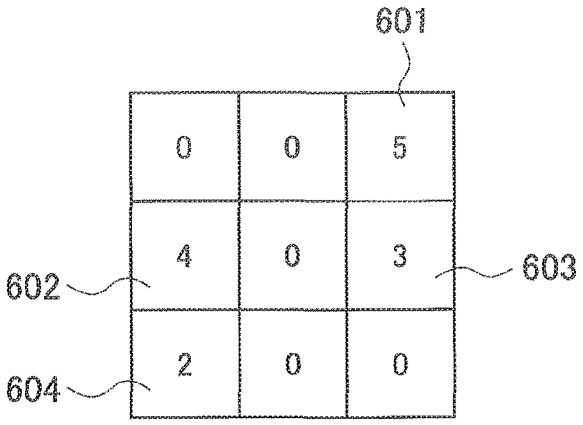
FIG. 6A is a diagram illustrating a discharge rate and showing original image data of 3×3 pixels in the central part of a gradation discharge section.
Figure 6B:
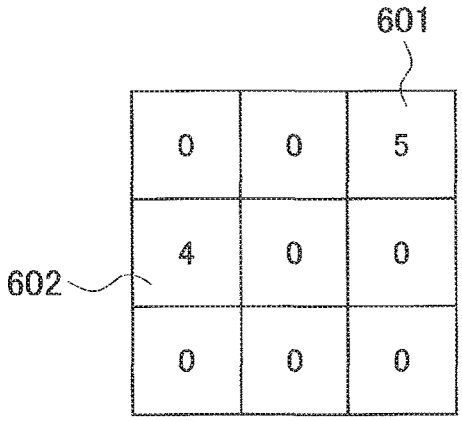
FIG. 6B is a diagram illustrating a discharge rate and showing image data of 3×3 pixels shown in FIG. 6A in the gradation discharge section of going-way side image data.
Figure 6C:
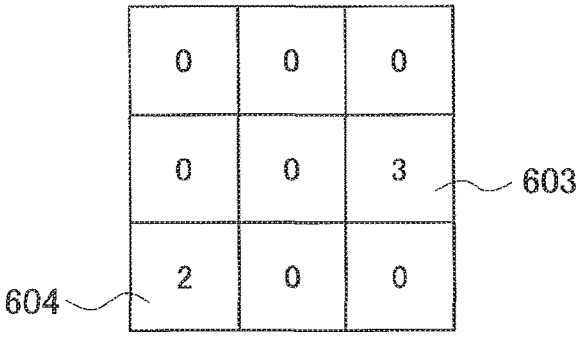
FIG. 6C is a diagram illustrating a discharge rate and showing image data of 3×3 pixels shown in FIG. 6A in the gradation discharge section of the returning-way side image data.

FIGS. 6A to 6C are diagrams illustrating discharge rates. FIG. 6A shows original image data of 3×3 pixels in a central part of the gradation discharge section. FIG. 6B shows image data of the 3×3 pixels shown in FIG. 6A in the gradation discharge section 201*b* of the going-way side image data 201. As the gradation discharge section has the gradation from 0 percent to 100 percent, the central part of the gradation discharge section has a discharge rate of 50 percent when the original image data in FIG. 6A has a discharge rate of 100 percent. FIG. 6C shows image data of the 3×3 pixels shown in FIG. 6A in the gradation discharge section 202*b* of the returning-way side image data 202. The central part of the gradation discharge section also has a discharge rate of 50 percent, the same as in the going-way side image data 201. The data here is shown as data converted into CMYK data of 0 to 7 from RGB data of 0 to 255 by halftone processing. FIGS. 6A to 6C show data of 'K', as an example.

As shown in FIG. 6A, the original image data of the 3×3 pixels in the central part of the gradation discharge section has the number of drops '5', '4', '3', and '2' respectively allocated to four pixels 601 to 604 and has the number of drops '0' allocated to the remaining five pixels among nine pixels. Such allocations represent respective values for all the elements in an area corresponding to the original data of the 3×3 elements.

The original image data of the 3×3 pixels has four pixels allocated as discharging pixels. As shown in FIG. 6B, the gradation discharge section 201*b* of the going-way side image data 201 has only the number of drops '5' and '4' allocated to the pixels 601 and 602 of the four pixels 601 to 604 of the original image data. In this way, the number of pixels for actual discharging is thinned out to the half of the number of pixels for discharging in the original image data. This enables the central part of the gradation discharge section 201*b* of the going-way side image data 201 to have a discharge rate of 50 percent when the original image data in FIG. 6A has a discharge rate of 100 percent.

In the same manner, as shown in FIG. 6C, the gradation discharge section 202*b* of the returning-way side image data 202 has only the number of drops '3' and '2' allocated to the pixels 603 and 604 of the four pixels 601 to 604 of the original image data. In this manner, the number of pixels for actual discharging is thinned out to the half of the number of pixels for discharging in the original image data. This enables the central part of the gradation discharge section 202*b* of the returning-way side image data 202 to have a discharge rate of 50 percent when the original image data in FIG. 6A has the discharge rate of 100 percent.

In the going way, while moving the head unit 22 in the right direction along the main-scanning drive guides 23A and 23B, the controlling unit 5 controls the inkjet heads 27 to discharge ink on the basis of image data of the discharge prohibition section 201*a* (discharge prohibition section image data), image data of the gradation discharge section 201*b* (gradation discharge section image data), and image data of the discharge section 201*c* (discharge section image data) from the upstream side. In this printing, as shown in FIG. 5B, the inkjet heads 27 discharge ink for only one-half of a head in the sub-scanning direction. For this reason, in the going way of the inkjet heads 27, the section 203*c*, which is on the downstream side and for one-half of a head in the sub-scanning direction on the base material 15, is printed, but the section 203*a*, which is on the upstream side and for one-half of a head in the sub-scanning direction on the base material 15, is not printed. The section 203*b* between the section 203*a* and the section 203*c* of the base material 15 is printed so that the discharge rate in the image data of the gradation discharge section 201*b* gradually increases to have the boundaries inconspicuous. Consequently, the base material 15 has the side surface 15*c* not printed, which is on the upstream side in the going way of the inkjet heads 27. This prevents the side surface 15*c* of the base material 15 on the upstream side from being stained.

In the going way, the section 203*c* of the base material 15 is printed, but the section 203*a* of the base material 15 is not printed. Moreover, the section 203*b* of the base material 15 is printed with a gradual discharge rate from zero discharge to the discharge rate in the discharge section. It is thus necessary to perform printing to complement the section 203*a* and the section 203*b* of the base material 15.

Then, when reaching the right end of the main-scanning drive guides 23A and 23B, the head unit 22 is moved in the sub-scanning direction for only one-half of a head. Subsequently printing is performed in the returning way to complement the section 203*a* and the section 203*b*, and at the same time for a section 204*a* and a section 204*b*.

In the returning way, while moving the head unit 22 in the left direction along the main-scanning drive guides 23A and 23B, the controlling unit 5 controls the inkjet heads 27 to discharge ink on the basis of image data of the discharge prohibition section 202*a* (discharge prohibition section image data), image data of the gradation discharge section 202*b* (gradation discharge section image data), and image data of the discharge section 202*c* (discharge section image data) from the upstream side. In this printing, as shown in FIG. 5B, the inkjet heads 27 discharge ink for one head in the sub-scanning direction.

In this manner, printing in the returning way of the inkjet heads 27 is performed to complement the section 203*a* and the section 203*b* of the base material 15, which have insufficient printing in the going way. This one cycle of reciprocation (2 passes) of the head unit 22 enables the sections 203*a* to 203*c*, which correspond to a line area for one-half of a head in the sub-scanning direction, to have the image reproduced with inconspicuous boundaries.

In the returning way of the inkjet heads 27, the section 204*a*, which is on the downstream side and for one-half of a head in the sub-scanning direction on the base material 15, is printed, but a section 204*c*, which is on the upstream side and for one-half of a head in the sub-scanning direction on the base material 15, is not printed. Moreover, the section 204*b* between the section 204*c* and the section 204*a* of the base material 15 is printed so that the discharge rate in the image data of the gradation discharge section 204*b* gradually increases to have the boundaries inconspicuous. Consequently, the base material 15 has the side surface 15*d* not printed, which is on the upstream side in the returning way of the inkjet heads 27. This prevents the side surface 15*d* of the base material 15 on the upstream side from being stained.

When the head unit 22 reaches the left end of the main-scanning drive guides 23A and 23B, the controlling unit 5 repeats: moving the head unit 22 in the sub-scanning direction for only one-half of a head; and while reciprocating the head unit 22 in the main-scanning direction, controlling the inkjet heads 27 to discharge ink on the basis of image data of the discharge prohibition section (discharge prohibition section image data), image data of the gradation discharge section (gradation discharge section image data), and image data of the discharge section (discharge section image data) from the upstream side. In the end of printing, the controlling unit 5 scans the inkjet heads 27 to perform printing for the last line area for one-half of a head in the sub-scanning direction on the image, which completes forming of the image.

As described above, in the going way, without performing printing for the section 203*a* on the upstream side of the base material 15, the head unit 22 performs printing for the section 203*b* and the section 203*c* along the main-scanning drive guides 23A and 23B. In the returning way, without performing printing for the section 203*c* on the upstream side of the base material 15, the head unit 22 performs printing for the section 203*a* and the section 203*b* along the main-scanning drive guides 23A and 23B. This prevents the side surfaces of the base material 15, which are on the upstream side, from being stained. Moreover, this makes the printing quality preferable without having the conspicuous boundaries of images as in the first embodiment, since there is the image data of the gradation discharge section between the section 203*a* and the section 203*c*.

Third Embodiment

The second embodiment of the present invention reproduces the image by moving the head unit 22 in the main-scanning direction for one cycle of reciprocation (2 passes) on each area of the base material 15. The present invention is however not limited to this.

The third embodiment of the present invention will describe the inkjet printing machine 1, which reproduces an image by moving the head unit 22 in the main-scanning direction for two cycles of reciprocation (4 passes) on each area of the base material 15, as an example.

FIGS. 7A to 7I are schematic diagrams illustrating workings of the inkjet printing machine 1 according to the third embodiment of the present invention.

As described above, each of the inkjet heads 27 includes a plurality of nozzles arranged along the front-back direction. Theses nozzles open on a nozzle surface, which is a lower surface of the inkjet head 27. Each of the inkjet heads 27 performs printing on the base material 15 by discharging ink drops from these nozzles. When a nozzle has ink clogging, for example and cannot discharge ink, a printed image may have a white streak.

The inkjet printing machine 1 according to the third embodiment of the present invention moves the head unit 22 in the main-scanning direction for two cycles of reciprocation (4 passes) on each area of the base material 15. This makes the white steak inconspicuous when a nozzle has the clogging, and prevents the side surfaces of the base material 15 from being stained as in the first embodiment and the second embodiment.

Figure 7A:
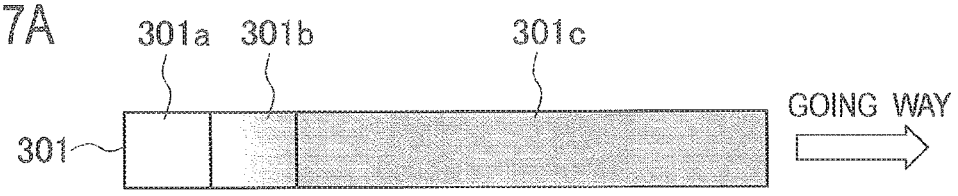
FIGS. 7A to 7I are schematic diagrams illustrating workings of the inkjet printing machine according to a third embodiment of the present invention.

As shown in FIG. 7A, going-way side image data 301 for the going way of the head unit 22 in the right-left direction (main-scanning direction) is generated from the image data. The going-way side image data 301 is for one-quarter of a head (for a divided pitch) in the sub-scanning direction, and divided into three sections of a discharge prohibition section, a gradation discharge section, and a discharge section from the upstream side. The discharge prohibition section is a section where the inkjet heads 27 do not discharged ink. The discharge section is a section where the inkjet heads 27 discharge ink at a discharge rate of 25 percent at maximum. The gradation discharge section is a section where the inkjet heads 27 discharge ink by raising the discharge rate in gradation from the discharge rate in the discharge prohibition section (zero discharge) to the discharge rate in the discharge section (discharge rate of 25 percent at maximum).

The going-way side image data 301 is divided into three sections of a discharge prohibition section 301*a*, a gradation discharge section 301*b*, and a discharge section 301*c* in order from the upstream side in the going way where the head unit 22 is moved in the left-to-right direction.

In the going way, while moving the head unit 22 in the right direction along the main-scanning drive guides 23A and 23B, the controlling unit 5 controls the inkjet heads 27 to discharge ink on the basis of image data of the discharge prohibition section 301*a* (discharge prohibition section image data), image data of the gradation discharge section 301*b* (gradation discharge section image data), and image data of the discharge section 301*c* (discharge section image data) from the upstream side. In this printing, as shown in FIG. 7A, the inkjet heads 27 discharge ink for only one-quarter of a head in the sub-scanning direction. Consequently, the base material 15 has the side surface not printed, which is on the upstream side in the going way of the inkjet heads 27. This prevents the side surface of the base material 15 on the upstream side from being stained.

When the head unit 22 reaches the right end of the main-scanning drive guides 23A and 23B, the head unit 22 is moved in the sub-scanning direction for only one-quarter of a head.

Figure 7B:
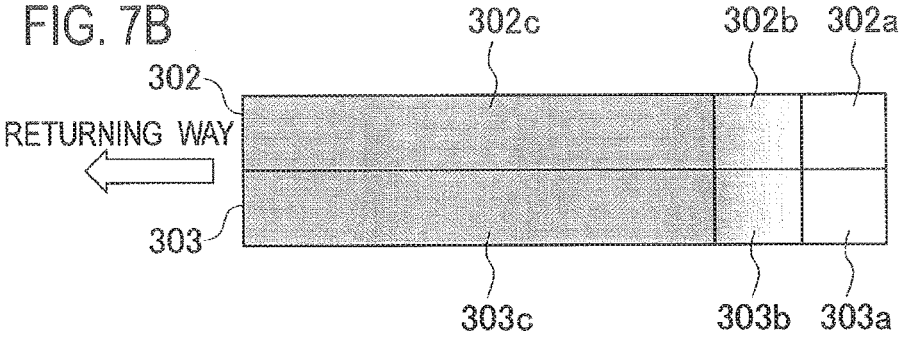

In the returning way, as shown in FIG. 7B, while moving the head unit 22 in the left direction along the main-scanning drive guides 23A and 23B, the controlling unit 5 controls the inkjet heads 27 to discharge ink on the basis of image data of discharge prohibition sections 302*a* and 303*a* (discharge prohibition section image data), image data of gradation discharge sections 302*b* and 303*b* (gradation discharge section image data), and image data of discharge sections 302*c* and 303*c* (discharge section image data) from the upstream side. In this printing, as shown in FIG. 7B, the inkjet heads 27 discharge ink for one-half of a head in the sub-scanning direction. Consequently, the base material 15 has the side surface not printed, which is on the upstream side in the returning way of the inkjet heads 27. This prevents the side surface of the base material 15 on the upstream side from being stained.

Figure 8A:
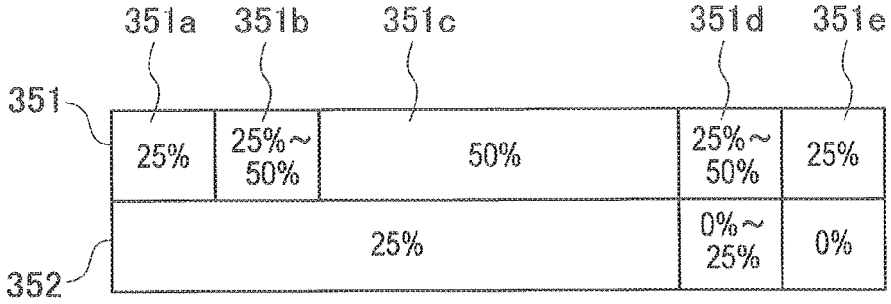
FIG. 8A is a diagram illustrating discharge rates in an image printed in a going way shown in FIG. 7A and in a returning way shown in FIG. 7B.

FIG. 8A is a diagram illustrating discharge rates in an image printed in the going way shown in FIG. 7A and in the returning way shown in FIG. 7B.

The controlling unit 5 moves the head unit 22 in the sub-scanning direction for one-quarter of a head at a time and controls the inkjet heads 27 to discharge ink. An image 351 shown in FIG. 8A is thus printed by superposing returning-way side image data 302 on the going-way side image data 301.

This forms sections of images 351*a* to 351*e* in the image 351.

The image 351*a* is a section where the image data of the discharge prohibition section 301*a* and the image data of the discharge section 302*c* overlap to have a discharge rate of 25 percent. The image 351*b* is a section where the image data of the gradation discharge section 301*b* and the image data of the discharge section 302*c* overlap to have a discharge rate of 25 to 50 percent. The image 351*c* is a section where the image data of the discharge section 301*c* and the image data of the discharge section 302*c* overlap to have a discharge rate of 50 percent. The image 351*d* is a section where the image data of the discharge section 301*c* and the image data of the gradation discharge section 302*b* overlap to have a discharge rate of 25 to 50 percent. The image 351*e* is a section where the image data of the discharge section 301*c* and the image data of the discharge prohibition section 302*a* overlap to have a discharge rate of 25 percent.

An image 352 is printed only on the basis of returning-way side image data 303 to have a discharge rate of 25 percent at maximum.

When the head unit 22 reaches the left end of the main-scanning drive units 23A and 23B, the head unit 22 is moved in the sub-scanning direction for only one-quarter of a head.

Figure 7C:
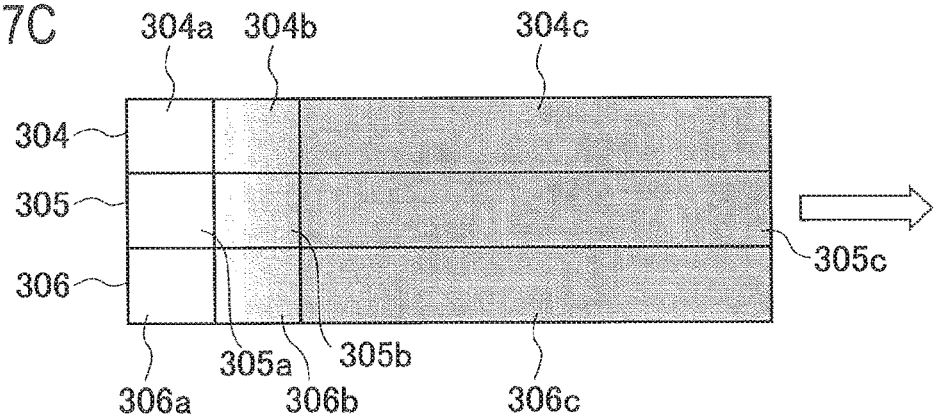

Again in the going way, as shown in FIG. 7C, while moving the head unit 22 in the right direction along the main-scanning drive guides 23A and 23B, the controlling unit 5 controls the inkjet heads 27 to discharge ink on the basis of image data of discharge prohibition sections 304*a*, 305*a*, and 306*a* (discharge prohibition section image data), image data of gradation discharge sections 304*b*, 305*b*, and 306*b* (gradation discharge section image data), and image data of discharge sections 304*c*, 305*c*, and 306*c* (discharge section image data) from the upstream side. In this printing, as shown in FIG. 7C, the inkjet heads 27 discharge ink for three-quarters of a head in the sub-scanning direction. Consequently, the base material 15 has the side surface not printed, which is on the upstream side in the going way of the inkjet heads 27. This prevents the side surface of the base material 15 on the upstream side from being stained.

Figure 8B:
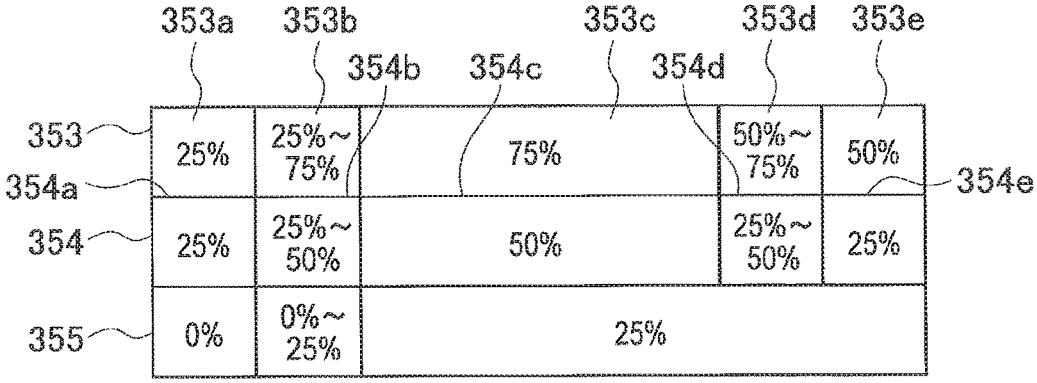
FIG. 8B is a diagram illustrating discharge rates in an image printed in the going way shown in FIG. 7A, in the returning way shown in FIG. 7B, and in a going way shown in FIG. 7C.

FIG. 8B is a diagram illustrating discharge rates in an image printed in the going way shown in FIG. 7A, in the returning way shown in FIG. 7B, and in the going way shown in FIG. 7C.

The controlling unit 5 moves the head unit 22 in the sub-scanning direction for one-quarter of a head at a time and controls the inkjet heads 27 to discharge ink. An image 353 shown in FIG. 8B is thus printed by superposing going-way side image data 304 on the going-way side image data 301 and the returning-way side image data 302.

This forms sections of images 353*a* to 353*e* in the image 353.

The image 353*a* is a section where the image data of the discharge prohibition section 301*a*, the image data of the discharge section 302*c*, and image data of the discharge prohibition section 304*a* overlap to have a discharge rate of 25 percent. The image 353*b* is a section where the image data of the gradation discharge section 301*b*, the image data of the discharge section 302*c*, and image data of the gradation discharge section 304*b* overlap to have a discharge rate of 25 percent to 75 percent. The image 353*c* is a section where the image data of the discharge section 301*c*, the image data of the discharge section 302*c*, and the image data of discharge section 304*c* overlap to have a discharge rate of 75 percent. The image 353*d* is a section where the image data of the discharge section 301*c*, the image data of the gradation discharge section 302*b*, and the image data of the discharge section 304*c* overlap to have a discharge rate of 50 percent to 75 percent. The image 353*e* is a section where the image data of the discharge section 301*c*, the image data of the discharge prohibition section 302*a*, and the image data of the discharge section 304*c* overlap to have a discharge rate of 50 percent.

An image 354 is formed by superposing going-way side image data 305 on the returning-way side image data 303 to have sections of images 354*a* to 354*e* as same as in the image 351.

An image 355 is printed only on the basis of going-way side image data 306 to have a discharge rate of 25 percent at maximum.

When the head unit 22 reaches the right end of the main-scanning drive guides 23A and 23B, the head unit 22 is moved in the sub-scanning direction for another one-quarter of a head.

Figure 7D:
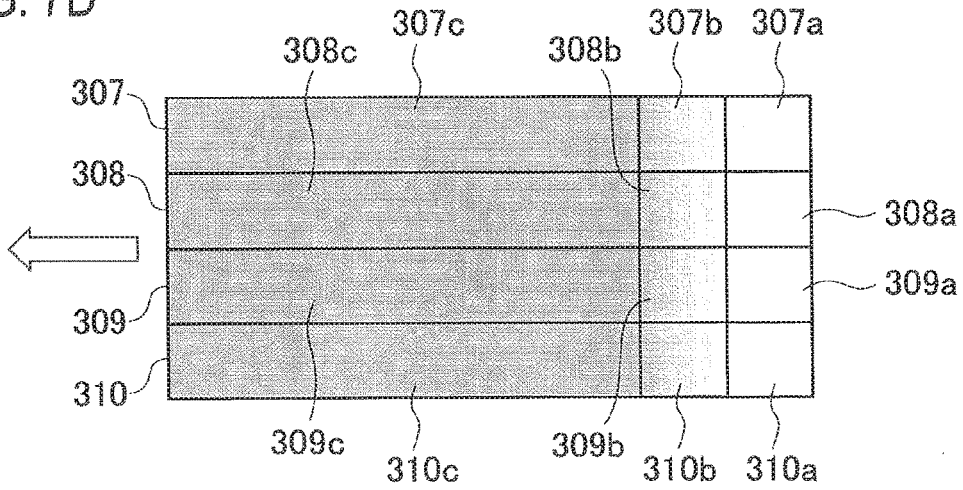

In the returning way, as shown in FIG. 7D, while moving the head unit 22 in the left direction along the main-scanning drive guides 23A and 23B, the controlling unit 5 controls the inkjet heads 27 to discharge ink on the basis of image data of discharge prohibition sections 307*a*, 308*a*, 309*a*, and 310*a* (discharge prohibition section image data), image data of gradation discharge sections 307*b*, 308*b*, 309*b*, and 310*b* (gradation discharge section image data), image data of discharge sections 307*c*, 308*c*, 309*c*, and 310*c* (discharge section image data) from the upstream side. In this printing, as shown in FIG. 7D, the inkjet heads 27 discharge ink for one head in the sub-scanning direction for the first time at the fourth pass (in two cycles of reciprocation). Consequently, the base material 15 has the side surface not printed, which is on the upstream side in the returning way of the inkjet heads 27. This prevents the side surface of the base material 15 on the upstream side from being stained.

Figure 8C:
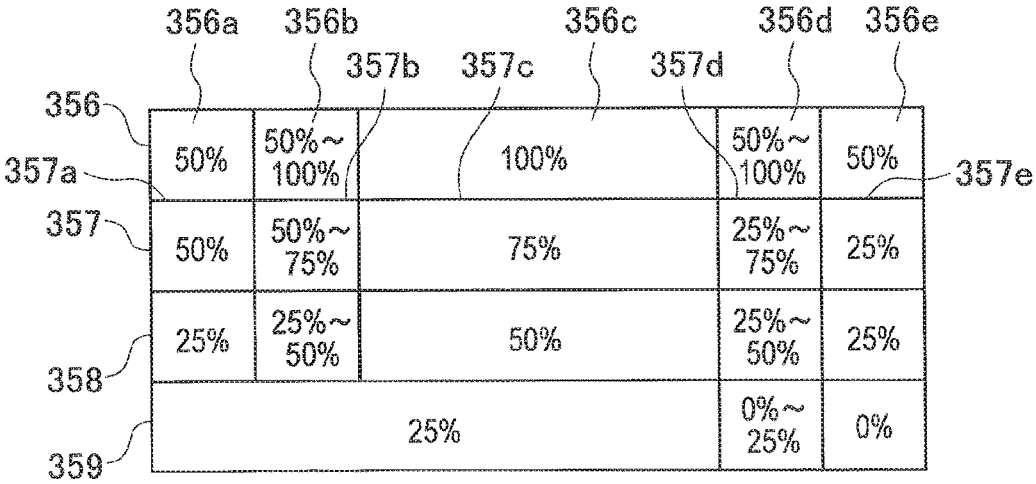
FIG. 8C is a diagram illustrating discharge rates in an image printed in the going way shown in FIG. 7A, in the returning way shown in FIG. 7B, in the going way shown in FIG. 7C, and in a returning way shown in FIG. 7D.

FIG. 8C is a diagram illustrating discharge rates in an image printed in the going way shown in FIG. 7A, in the returning way shown in FIG. 7B, in the going way shown in FIG. 7C, and in the returning way shown in FIG. 7D.

The controlling unit 5 moves the head unit 22 in the sub-scanning direction for one-quarter of a head at a time and controls the inkjet heads 27 to discharge ink. An image 356 shown in FIG. 8C is thus printed by superposing returning-way side image data 307 on the going-way side image data 301, the returning-way side image data 302, and the going-way side image data 304.

This forms sections of images 356*a* to 356*e* in the image 356.

The image 356*a* is a section where the image data of the discharge prohibition section 301*a*, the image data of the discharge section 302*c*, the image data of the discharge prohibition section 304*a*, and image data of the discharge section 307*c* overlap to have a discharge rate of 50 percent. The image 356*b* is a section where the image data of the gradation discharge section 301*b*, the image data of the discharge section 302*c*, the image data of the gradation discharge section 304*b*, and the image data of the discharge section 307*c* overlap to have a discharge rate of 50 to 100 percent. The image 356*c* is a section where the image data of the discharge section 301*c*, the image data of the discharge section 302*c*, the image data of the discharge section 304*c*, and the image data of the discharge section 307*c* overlap to have a discharge rate of 100 percent. The image 356*d* is a section where the image data of the discharge section 301*c*, the image data of the gradation discharge section 302*b*, the image data of discharge section 304*c*, and the image data of the gradation discharge section 307*b* overlap to have a discharge rate of 50 to 100 percent. The image 356*e* is a section where the image data of the discharge section 301*c*, the image data of the discharge prohibition section 302*a*, the image data of the discharge section 304*c*, and the image data of the discharge prohibition section 307*a* overlap to have a discharge rate of 50 percent.

An image 357 is formed by superposing returning-way side image data 308 on the returning-way side image data 303 and the going-way side image data 305 to have sections of images 357*a* to 357*e*.

An image 358 is formed by superposing returning-way side image data 309 on the going-way side image data 306 to have five sections.

An image 359 is printed only on the basis of going-way side image data 310 to have a discharge rate of 25 percent at maximum.

Figure 7E:
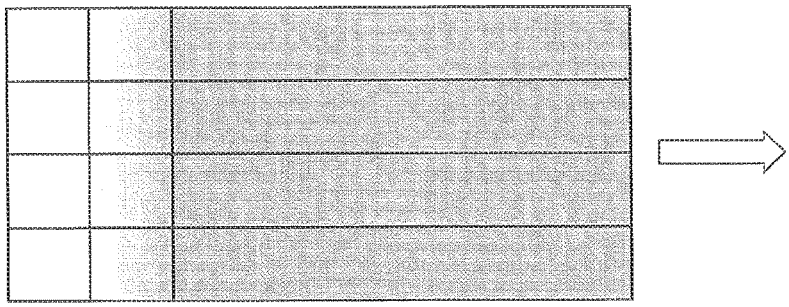
Figure 7F:
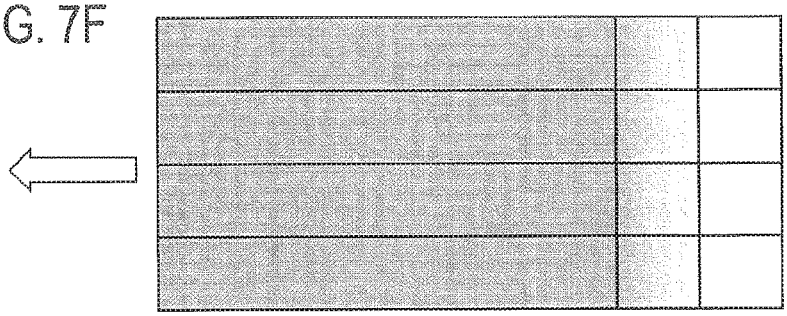

From this point forward, as shown in FIGS. 7E and 7F, in each of the going way and the returning way, the controlling unit 5 moves the head unit 22 in the sub-scanning direction for only one-quarter of a head at a time, and then controls the inkjet heads 27 to discharge ink on the basis of the image data of the discharge prohibition section (discharge prohibition section image data), the image data of the gradation discharge section (gradation discharge section image data), and the image data of the discharge section (discharge section image data) from the upstream side, which are for one head in the sub-scanning direction.

When the head unit 22 comes close to the end of the base material 15 in the sub-scanning direction, the controlling unit 5 narrows the area in the sub-scanning direction, on which the inkjet heads 27 discharge ink, by one-quarter of a head at a time.

Figure 7G:
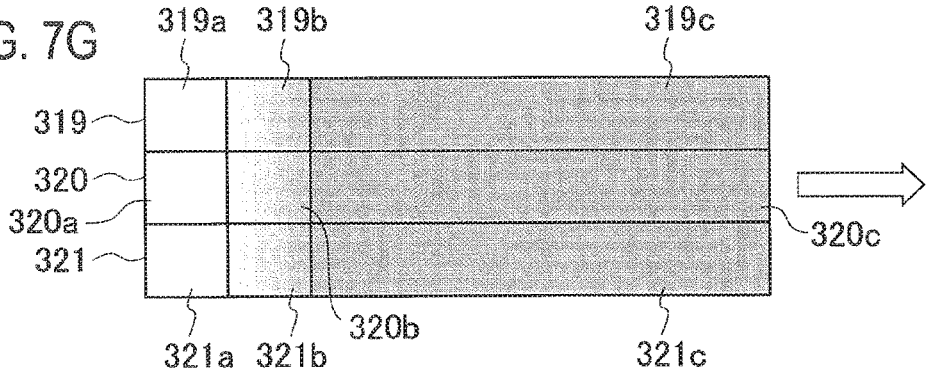

Specifically, as shown in FIG. 7G, in the going way, while moving the head unit 22 in the right direction along the main-scanning drive guides 23A and 23B, the controlling unit 5 controls the inkjet heads 27 to discharge ink on the basis of image data of discharge prohibition sections 319*a*, 320*a*, and 321*a* (discharge prohibition section image data), image data of gradation discharge sections 319*b*, 320*b*, and 321*b* (gradation discharge section image data), and discharge sections 319*c*, 320*c*, and 321*c* (discharge section image data) from the upstream side, which are for three-quarters of a head in the sub-scanning direction.

Figure 7H:
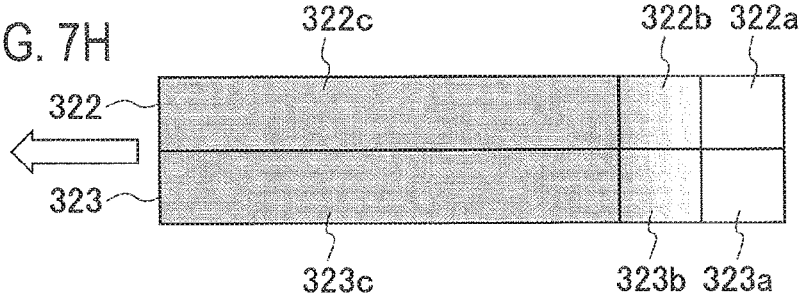
Figure 7I:
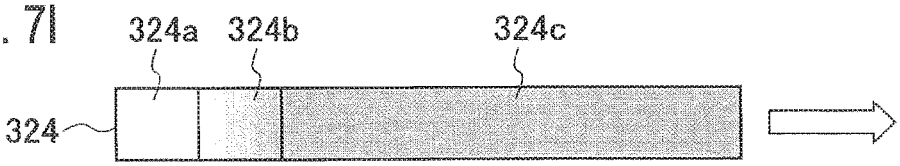

Subsequently, as shown in FIG. 7H, the controlling unit 5 controls the inkjet heads 27 to discharge ink on the basis of image data of discharge prohibition sections 322*a* and 323*a* (discharge prohibition section image data), image data of gradation discharge sections 322*b* and 323*b* (gradation discharge section image data), and discharge sections 322*c* and 323*c* (discharge section image data) from the upstream side, which are for one-half of a head in the sub-scanning direction. At last, as shown in FIG. 7I, the controlling unit 5 controls the inkjet heads 27 to discharge ink on the basis of image data of a discharge prohibition section 324*a* (discharge prohibition section image data), image data of a gradation discharge section 324*b* (gradation discharge section image data), and image data of a discharge section 324*c* (discharge section image data) from the upstream side, which are for one-quarter of a head in the sub-scanning direction.

In this way, in each of the going way and in the returning way, the controlling unit 5 controls the inkjet heads 27 to discharge ink on the basis of the discharge prohibition section image data, the gradation discharge section image data, and the discharge section image data from the upstream side. Consequently, the base material 15 has the side surface not printed, which is on the upstream side in each of the going way and the returning way of the inkjet heads 27. This prevents the side surface of the base material 15 on the upstream side from being stained.

The printing is performed by moving the head unit 22 in the main-scanning direction for two cycles of reciprocation (4 passes) on each area of the base material 15. This makes the white steak inconspicuous even when a nozzle has the clogging.

Fourth Embodiment

The third embodiment of the present invention describes the inkjet printing machine 1, which divides the image data into three sections and controls the head unit 22 to discharge ink on each area of the base material 15 on the basis of the three divided image data to reproduce an image while reciprocating the head unit 22 two cycles of reciprocation (four passes) in the main-scanning direction, as an example. In this case, the white steak is made inconspicuous, but discharge rates are low in sections at both ends and in the gradation sections. In such sections, it is thus preferable to perform printing at appropriate discharge rates without decreasing the discharge rates.

The fourth embodiment will describe the inkjet printing machine 1, which divides image data into five sections and controls the head unit 22 to discharge ink on each area of the base material 15 on the basis of the five divided image data to reproduce an image while moving the head unit 22 to reciprocate two cycles of reciprocation (four passes) in the main-scanning direction, as an example.

FIGS. 9A to 9I are schematic diagrams illustrating workings of the inkjet printing machine 1 according to the fourth embodiment.

Figure 9A:
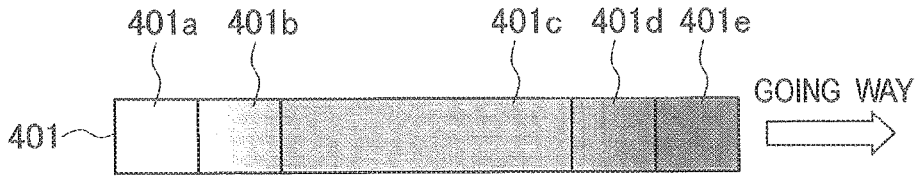
FIGS. 9A to 9I are schematic diagrams illustrating workings of the inkjet printing machine according to a fourth embodiment of the present invention.

As shown in FIG. 9A, going-way side image data 401 for the going way of the head unit 22 in the right-left direction (main-scanning direction) are generated from the image data. The going-way side image data 401 are for one-quarter of a head in the sub-scanning direction and divided into five sections of a discharge prohibition section 401*a*, a first gradation discharge section 401*b*, a first discharge section 401*c*, a second gradation discharge section 401*d*, and a second discharge section 401*e* from the upstream side. The discharge prohibition section is a section where the inkjet heads 27 do not discharge ink. The first discharge section is a section where the inkjet heads 27 discharge ink at a discharge rate of 25 percent at maximum. The first gradation discharge section is a section where the inkjet heads 27 discharge ink by raising the discharge rate in gradation from the discharge rate in the discharge prohibition section (zero percent) to the discharge rate in the first discharge section (25 percent at maximum). The second discharge section is a section where the inkjet heads 27 discharge ink at a discharge rate of 50 percent at maximum. The second gradation discharge section is a section where the inkjet heads 27 discharge ink by raising the discharge rate in gradation from the discharge rate in the first discharge section (25 percent) to the discharge rate in the second discharge section (50 percent at maximum).

In the going way, while moving the head unit 22 in the right direction along the main-scanning drive guides 23A and 23B, the controlling unit 5 controls the inkjet heads 27 to discharge ink on the basis of image data of the discharge prohibition section 401*a* (discharge prohibition section image data), image data of the first gradation discharge section 401*b* (first gradation discharge section image data), image data of the first discharge section 401*c* (first discharge section image data), image data of the second gradation discharge section 401*d* (second gradation discharge section image data), and image data of the second discharge section 401*e* (second discharge section image data) from the upstream side.

In this printing, as shown in FIG. 9A, the inkjet heads 27 discharge ink for only one-quarter of a head in the sub-scanning direction.

When the head unit 22 reaches the right end of the main-scanning drive guides 23A and 23B, the head unit 22 is moved in the sub-scanning direction for only one-quarter of a head.

Figure 9B:
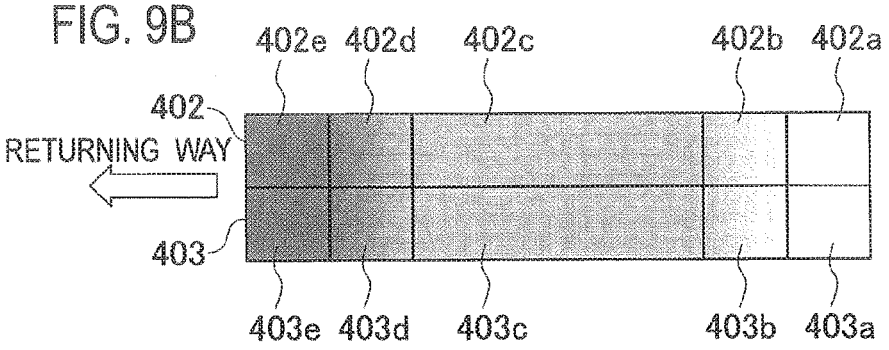

In the returning way, as shown in FIG. 9B, while moving the head unit 22 in the left direction along the main-scanning drive guides 23A and 23B, the controlling unit 5 controls the inkjet heads 27 to discharge ink on the basis of image data of discharge prohibition sections 402*a* and 403*a* (discharge prohibition section image data), image data of first gradation discharge sections 402*b* and 403*b* (first gradation discharge section image data), image data of first discharge sections 402*c* and 403*c* (first discharge section image data), image data of second gradation discharge sections 402*d* and 403*d* (gradation discharge section image data), and image data of second discharge sections 402*e* and 403*e* (second discharge section image data) from the upstream side. In this printing, as shown in FIG. 9B, the inkjet heads 27 discharge ink for one-half of a head in the sub-scanning direction.

Figure 10A:
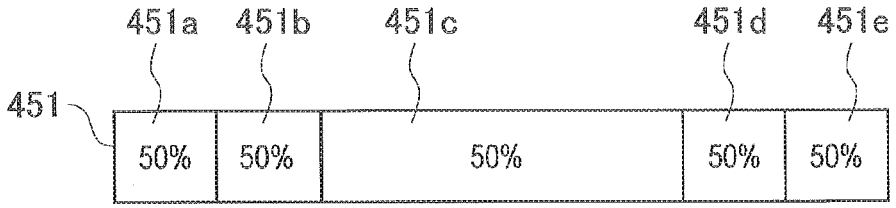
FIG. 10A is a diagram illustrating discharge rates for a first pitch of divided pitches in superposed images that are printed in a going way shown in FIG. 9A and in a returning way shown in FIG. 9B.

FIG. 10A is a diagram illustrating discharge rates for a first pitch of divided pitches in superposed images that are printed in the going way shown in FIG. 9A and in the returning way shown in FIG. 9B. It is noted that description is omitted in FIGS. 10A to 10C for images superposed in divided pitches other than the first pitch.

The controlling unit 5 moves the head unit 22 in the sub-scanning direction for one-quarter of a head at a time and controls the head unit 22 to discharge ink. An image 451 shown in FIG. 10A is thus printed by superposing the returning-way side image data 402 on the going-way side image data 401.

This forms sections of images 451*a* to 451*e* in the image 451.

The image 451*a* is a section where image data of the discharge prohibition section 401*a* and image data of the second discharge section 402*e* overlap to have a discharge rate of 50 percent. The image 451*b* is a section where image data of the first gradation discharge section 401*b* and image data of the second gradation discharge section 402*d* overlap to have a discharge rate of 50 percent. The image 451*c* is a section where the image data of the first discharge section 401*c* and the image data of the first discharge section 402*c* overlap to have a discharge rate of 50 percent. The image 451*d* is a section where the image data of the second gradation discharge section 401*d* and the image data of the first gradation discharge section 402*b* overlap to have a discharge rate of 50 percent. The image 451*e* is a section where the image data of the second discharge section 401*e* and the image data of the discharge prohibition section 402*a* overlap to have a discharge rate of 50 percent.

When the head unit 22 reaches the left end of the main-scanning drive guides 23A and 23B, the head unit 22 is moved in the sub-scanning direction for only one-quarter of a head.

Figure 9C:
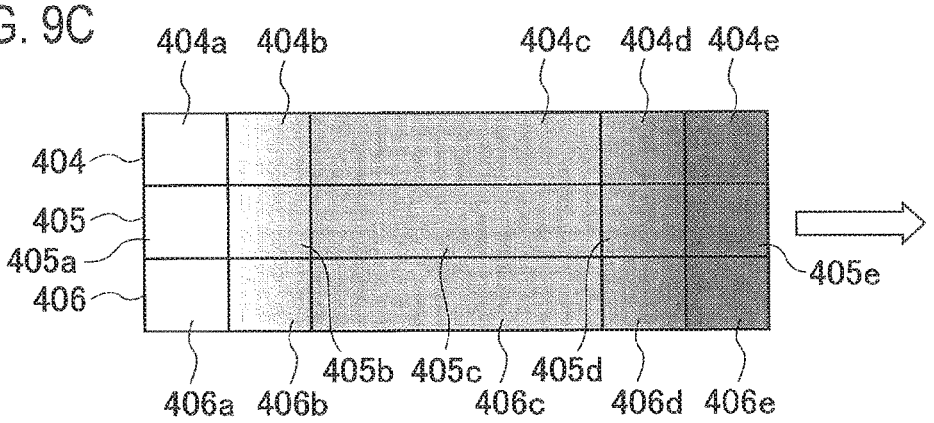

Again in the going way, as shown in FIG. 9C, while moving the head unit 22 in the right direction along the main-scanning drive guides 23A and 23B, the controlling unit 5 controls the inkjet heads 27 to discharge ink on the basis of image data of discharge prohibition sections 404*a*, 405*a*, and 406*a* (discharge prohibition section image data), image data of first gradation discharge sections 404*b*, 405*b*, and 406*b* (first gradation discharge section image data), image data of first discharge sections 404*c*, 405*c*, and 406*c* (first discharge section image data), and image data of second gradation discharge sections 404*d*, 405*d*, and 406*d* (second gradation discharge section image data), image data of second discharge sections 404*e*, 405*e*, and 406*e* (second discharge section image data) from the upstream side. In this printing, as shown in FIG. 9C, the inkjet heads 27 discharge ink for three-quarters of a head in the sub-scanning direction.

Figure 10B:
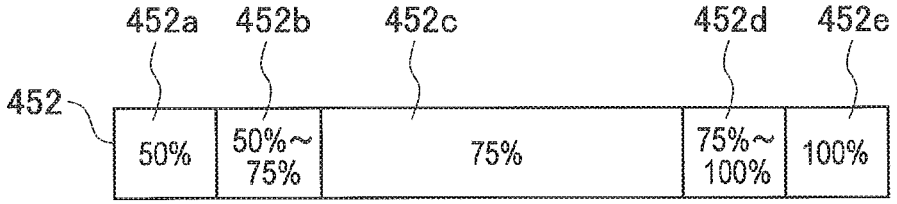
FIG. 10B is a diagram illustrating discharge rates for the first pitch of divided pitches in superposed images that are printed in the going way shown in FIG. 9A, in the returning way shown in FIG. 9B, and in a going way shown in FIG. 9C.

FIG. 10B is a diagram illustrating discharge rates for the first pitch of the divided pitches in superposed images that are printed in the going way shown in FIG. 9A, in the returning way shown in FIG. 9B, and in the going way shown in FIG. 9C.

The controlling unit 5 moves the head unit 22 in the sub-scanning direction for one-quarter of a head at a time and controls the head unit 22 to discharge ink. An image 452 shown in FIG. 10B is thus printed by superposing going-way side image data 404 on the going-way side image data 401 and the returning-way side image data 402.

This forms sections of images 452*a* to 452*e* in the image 452.

The image 452*a* is a section where the image data of the discharge prohibition section 401*a*, the image data of the second discharge section 402*e*, and image data of the discharge prohibition section 404*a* overlap to have the discharge rate of 50 percent. The image 452*b* is a section where the image data of the first gradation discharge section 401*b*, the image data of the second gradation discharge section 402*d*, and image data of the first gradation discharge section 404*b* overlap to have the discharge rate of 50 percent to 75 percent. The image 452*c* is a section where the image data of the first discharge section 401*c*, the image data of the first discharge section 402*c*, and image data of the first discharge section 404*c* overlap to have the discharge rate of 75 percent. The image 452*d* is a section where the image data of the second gradation discharge section 401*d*, the image data of the first gradation discharge section 402*b*, and image data of the second gradation discharge section 404*d* overlap to have the discharge rate of 75 percent to 100 percent. The image 452*e* is a section where the image data of the second discharge section 401*e*, the image data of the discharge prohibition section 402*a*, and image data of the second discharge section 404*e* overlap to have the discharge rate of 100 percent.

When the head unit 22 reaches the right end of the main-scanning drive guides 23A and 23B, the head unit 22 is moved in the sub-scanning direction for only one-quarter of a head.

Figure 9D:
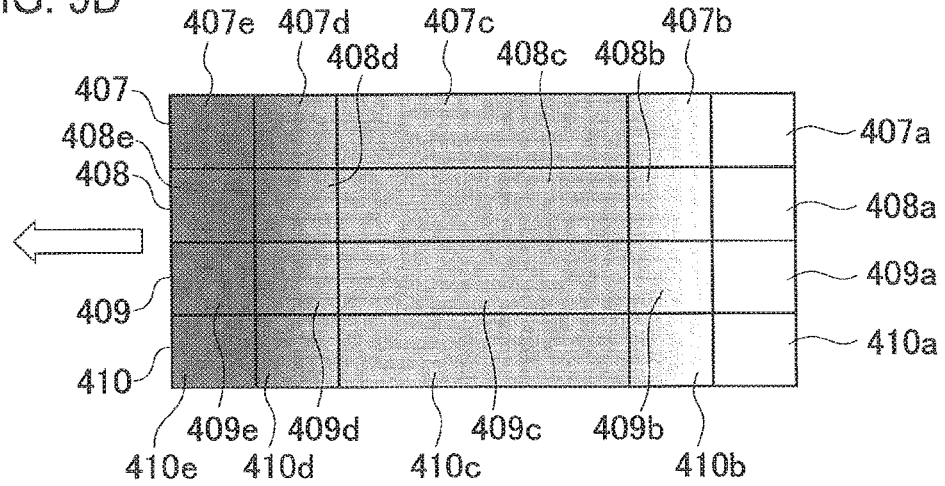

In the returning way, as shown in FIG. 9D, while moving the head unit 22 in the left direction along the main-scanning drive guides 23A and 23B, the controlling unit 5 controls the inkjet heads 27 to discharge ink on the basis of image data of discharge prohibition sections 407*a*, 408*a*, 409*a*, and 410*a* (discharge prohibition section image data), image data of first gradation discharge sections 407*b*, 408*b*, 409*b*, and 410*b* (first gradation discharge section image data), image data of first discharge sections 407*c*, 408*c*, 409*c*, and 410*c* (first discharge section image data), and image data of second gradation discharge sections 407*d*, 408*d*, 409*d*, and 410*d* (second gradation discharge section image data), image data of second discharge sections 407*e*, 408*e*, 409*e*, and 410*e* (second discharge section image data) from the upstream side. In this printing, as shown in FIG. 9D, the inkjet heads 27 discharge ink for one head in the sub-scanning direction for the first time at the fourth pass (in two cycles of reciprocation).

Figure 10C:
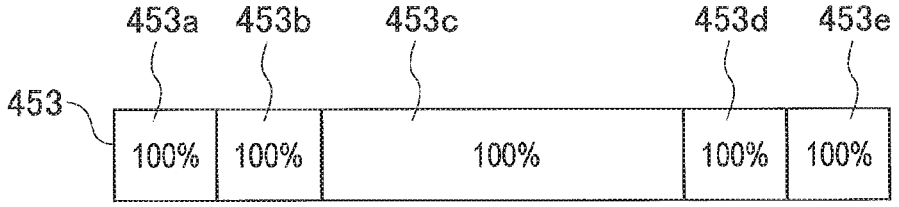
FIG. 10C is a diagram illustrating discharge rates for the first pitch of divided pitches in superposed images that are printed in the going way shown in FIG. 9A, in the returning way shown in FIG. 9B, in the going way shown in FIG. 9C, and in a returning way shown in FIG. 9D.

FIG. 10C is a diagram illustrating discharge rates for the first pitch of divided pitches in superposed images that are printed in the going way shown in FIG. 9A, in the returning way shown in FIG. 9B, in the going way shown in FIG. 9C, and in the returning way shown in FIG. 9D.

The controlling unit 5 moves the head unit 22 in the sub-scanning direction for one-quarter of a head at a time and controls the head unit 22 to discharge ink. An image 453 shown in FIG. 10C is thus printed by superposing returning-way side image data 407 on the going-way side image data 401, the returning-way side image data 402, and the going-way side image data 404.

This forms sections of images 453*a* to 453*e* in the image 453. The going-way side image data 401, the returning-way side image data 402, the going-way side image data 404, and the returning-way side image data 407 are superposed to have a discharge rate of 100 percent in all the sections.

Figure 9E:
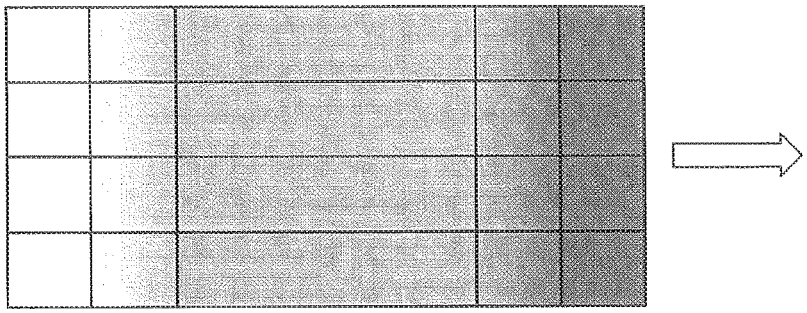
Figure 9F:
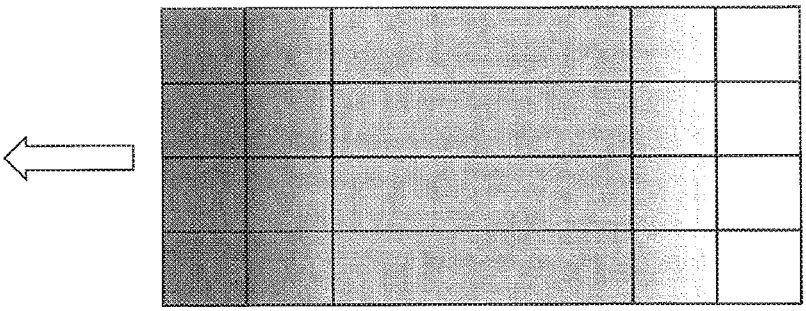

From this point forward, as shown in FIGS. 9E and 9F, in each of the going way and the returning way, the controlling unit 5 moves the head unit 22 in the sub-scanning direction for only one-quarter of a head at a time, and then controls the inkjet heads 27 to discharge ink on the basis of image data of the discharge prohibition section (discharge prohibition section image data), image data of the first gradation discharge section (first gradation discharge section image data), image data of the first discharge section (first discharge section image data), image data of the second gradation discharge section (second gradation discharge section image data), and image data of the second discharge section (second discharge section image data) from the upstream side, which are for one head in the sub-scanning direction.

Figure 9G:
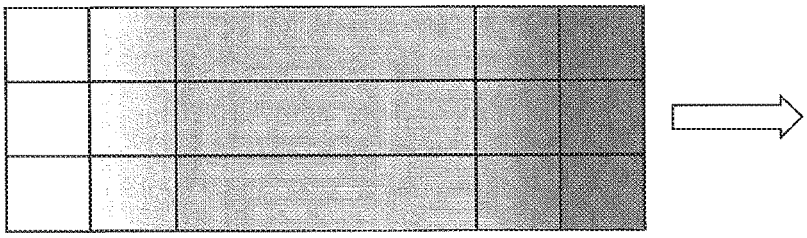
Figure 9H:
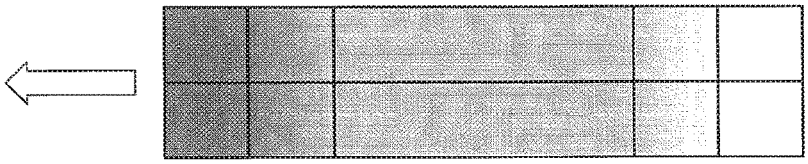
Figure 9I:
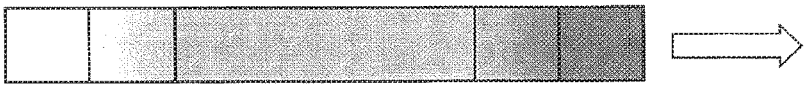

When the head unit 22 comes close to the end of the base material 15 in the sub-scanning direction, the controlling unit 5 narrows the area in the sub-scanning direction, on which the inkjet heads 27 discharge ink, by one-quarter of a head at a time, as shown in FIGS. 9G to 9I.

In this manner, in each of the going way and the returning way, the inkjet heads 27 discharge ink on the basis of the discharge prohibition section image data, the first gradation discharge section image data, the first discharge section image data, the second gradation discharge section image data, and the second discharge section image data from the upstream side. Consequently, the base material 15 has the side surface not printed, which is on the upstream side in each of the going way and the returning way of the inkjet heads 27. This prevents the side surface of the base material 15 on the upstream side from being stained, and achieves fine finish without decreasing the discharge rates also at the ends of the base material 15.

The printing is performed by moving the head unit 22 in the main-scanning direction for two cycles of reciprocation (4 passes) on each area of the base material 15. This makes the white steak inconspicuous even when a nozzle has the clogging.

In comparison with the third embodiment, the fourth embodiment prevents the discharge rates from decreasing in all the sections and achieves printing with the discharge rate of 100 percent to have preferable printing quality.

Fifth Embodiment

The first embodiment to the fourth embodiment of the present invention describe the inkjet printing machine 1, which discharges ink on the plate-like base material 15 having no unevenness, as an example. In the fifth embodiment, the base material 15 is not limited to the plate having no unevenness.

The fifth embodiment will describe the inkjet printing machine 1, which discharges ink on the base material 15 having a penetration hole in a thickness direction, as an example.

Figure 11A:
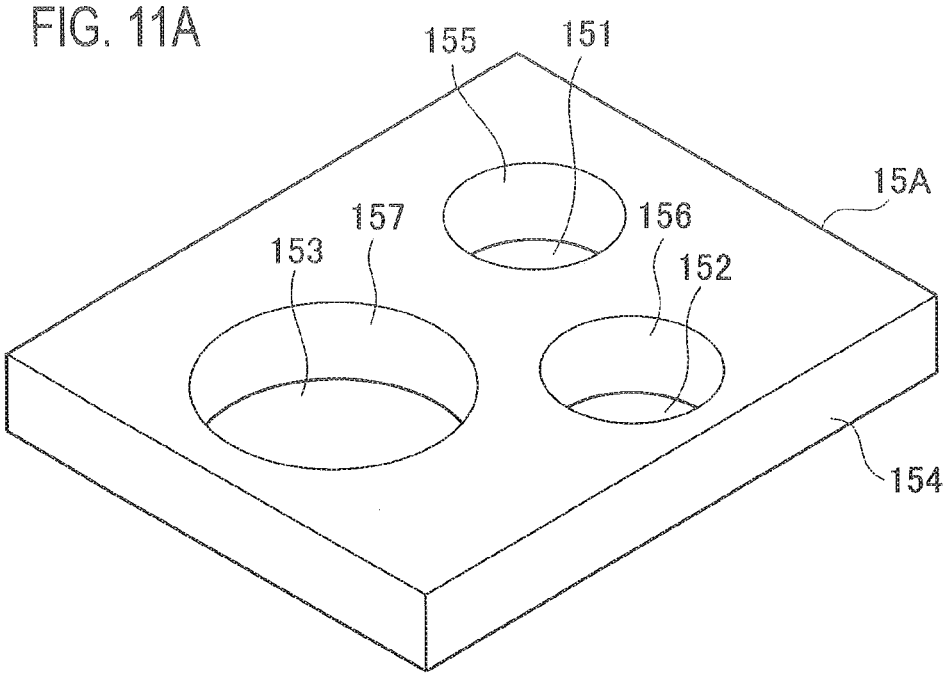
FIG. 11A is a perspective view of a base material on which printing is to be performed by the inkjet printing machine according to a fifth embodiment of the present invention.
Figure 11B:
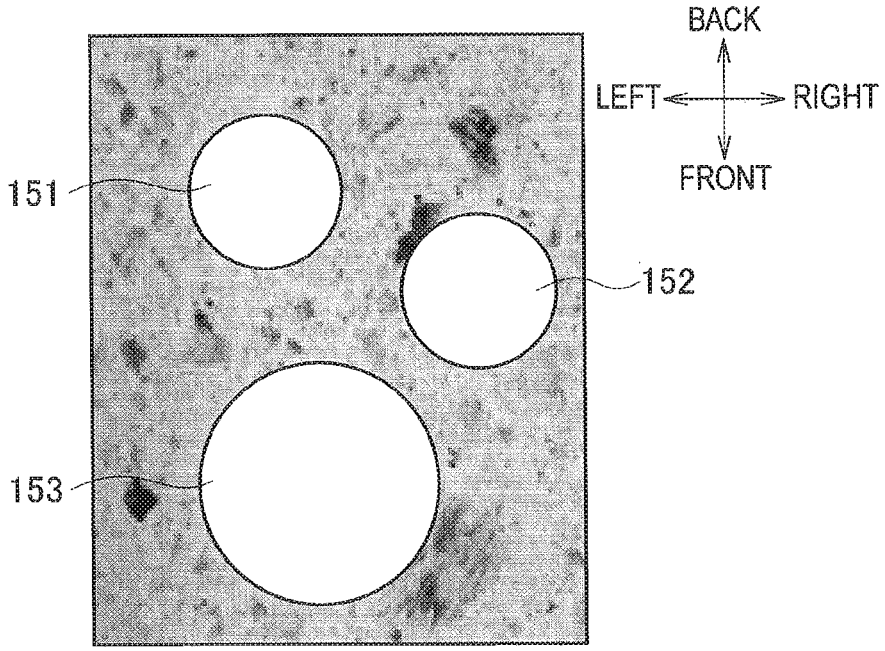
FIG. 11B is a plain view of a printed base material on which margin-less printing has been performed by the inkjet printing machine according to the fifth embodiment of the present invention.

FIG. 11A is a perspective view of a base material on which printing is to be performed by the inkjet printing machine 1 according to the fifth embodiment. FIG. 11B is a plain view of a printed base material on which margin-less printing has been performed by the inkjet printing machine 1 according to the fifth embodiment.

As shown in FIG. 11A, a base material 15A is formed with round penetration holes 151, 152, and 153. The inkjet printing machine 1 according to the fifth embodiment performs margin-less printing on the surface of the base material 15A without performing printing on side surfaces 154 of the base material 15A, and side surfaces 155, 156, and 157 of the penetration holes 151, 152, and 153 to obtain the printed base material 15A shown in FIG. 11B.

Figure 12A:
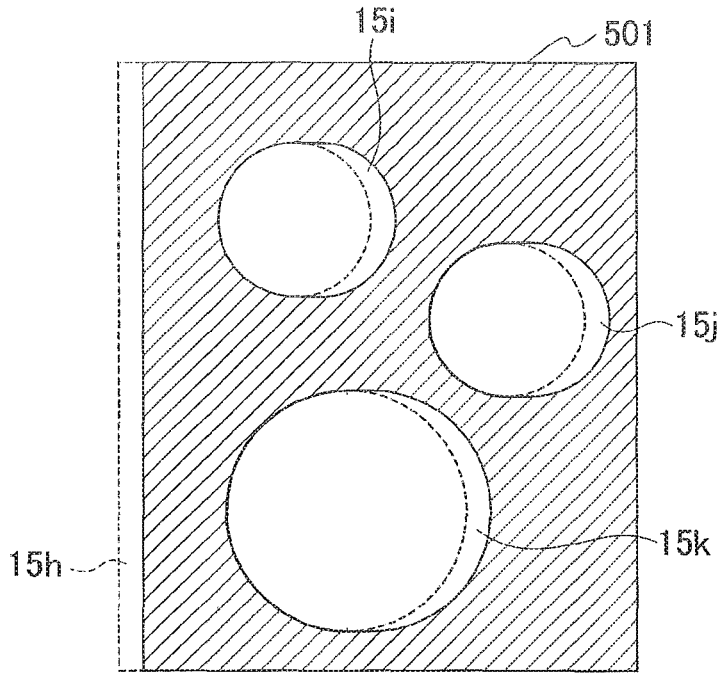
FIG. 12A is a diagram showing an example of going-way side image data for which the inkjet printing machine according to the fifth embodiment of the present invention performs printing.
Figure 12B:
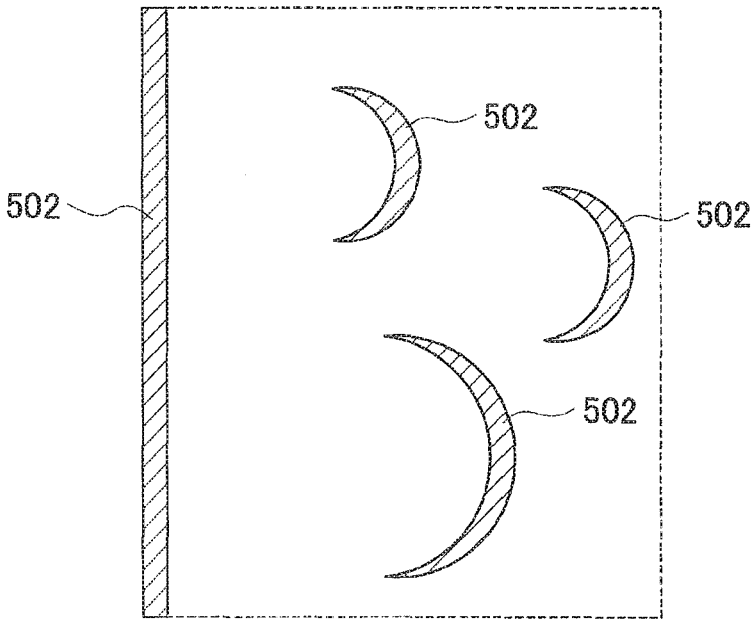
FIG. 12B is a diagram showing an example of returning-way side image data for which the inkjet printing machine according to the fifth embodiment of the present invention performs printing.

To perform margin-less printing, the controlling unit 5 functions as image dividing means before performing the print operation. As shown in FIGS. 12A and 12B, the controlling unit 5 divides image data, which have a size larger than that of the base material 15A, into two image data of going-way side image data 501 and returning-way side image data 502.

In the going way, while moving the head unit 22 in the right direction along the main-scanning drive guides 23A and 23B, the controlling unit 5 controls the inkjet heads 27 to discharge ink not using the returning-way side image data 502 but using only the going-way side image data 501 on the downstream side in the main-scanning direction. In the going way of the head unit 22, a left part 15*h* of the base material 15, which is on the upstream side, and right parts 15*i*, 15*j*, and 15*k* of the penetration holes 151, 152, and 153, which are on the surface of the base material 15A, are not printed. This prevents the side surfaces of the base material 15A on the upstream side from being stained.

In the going way, the left part 15*h* of the base material 15 and the right parts 15*i*, 15*j*, and 15*k* of the penetration holes 151, 152, and 153, are not printed. It is thus necessary to perform printing to complement these parts.

Then, when the head unit 22 reaches the right end of the main-scanning drive guides 23A and 23B, without moving the head unit 22 in the sub-scanning direction, printing in the returning way is performed to complement the left part 15*h* of the base material 15 and the right parts 15*i*, 15*j*, and 15*k* of the penetration holes 151, 152, and 153.

In the returning way, while moving the head unit 22 in the left direction along the main-scanning drive guides 23A and 23B, the controlling unit 5 controls the inkjet heads 27 to discharge ink using only the returning-way side image data 502, which is on the downstream side in the main-scanning direction. Consequently, in the returning way of the inkjet heads 27, the left part 15*h* of the base material 15, which on the downstream side, and the right parts 15*i*, 15*j*, and 15*k* of the penetration holes 151, 152, and 153, are thus printed for one head in the sub-scanning direction.

As describe above, the head unit 22 performs printing in the going way on the basis of the going-way side image data 501, and performs printing in the returning way on the basis of the returning-way side image data 502 along the main-scanning drive guides 23A and 23B. One cycle of reciprocation enables printing to be performed without staining the side surfaces of the base material 15 and the side surfaces of the penetration holes 151, 152, and 153.

What is claimed is:

1. An inkjet printing machine that has a moving device to move an inkjet head in a main-scanning direction and in a sub-scanning direction, and performs margin-less printing on a base material by alternately repeating:

an operation of discharging ink from the inkjet head based on a discharge rate that represents a ratio of a number of pixels for actually discharging ink to a number of pixels for an object to be discharged in image data having a size larger than that of the base material while relatively moving the base material and the inkjet head in the main-scanning direction; and an operation of moving the inkjet head in the sub-scanning direction after discharging ink in the main-scanning direction is finished, the inkjet printing machine comprising:

an image data generator that generates image data corresponding to each of divided pitches, based on image data corresponding to each pitch for moving the inkjet head in the sub-scanning direction where the pitch is divided into a plurality of divided pitches, in a manner such that:

the image data corresponding to each of the divided pitches includes, along a moving direction in the main-scanning direction, a discharge prohibition section for not discharging ink, a discharge section for discharging ink, and a gradation discharge section between the discharge prohibition section and the discharge section for discharging ink by raising a discharge rate in gradation to a discharge rate in the discharge section; and the discharge section of each of the divided pitches is superposed for the number of the divided pitches in each pitch to have a discharge rate in each pitch; and a controller that, when margin-less printing is performed based on the image data corresponding to each of the divided pitches, stops discharging ink in the discharge prohibition section and discharges ink in an order of the gradation discharge section and the discharge section when the inkjet head is moved by the moving device along the main-scanning direction from an outside of the base material toward an end of the base material, and thereafter moves the inkjet head for one divided pitch.

* * * * *